US008613195B2

(12) United States Patent
Held et al.

(10) Patent No.: US 8,613,195 B2
(45) **Date of Patent: *Dec. 24, 2013**

(54) HEAT ENGINE AND HEAT TO ELECTRICITY SYSTEMS AND METHODS WITH WORKING FLUID MASS MANAGEMENT CONTROL

(75) Inventors: Timothy J. Held, Akron, OH (US); Stephen Hostler, Akron, OH (US); Jason D. Miller, Hudson, OH (US); Michael Vermeersch, Hamilton, OH (US); Tao Xie, Copley, OH (US)

(73) Assignee: Echogen Power Systems, LLC, Akron, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/278,705

(22) Filed: Oct. 21, 2011

(65) Prior Publication Data

US 2012/0047892 A1 Mar. 1, 2012

Related U.S. Application Data

(63) Continuation-in-part of application No. 12/631,379, filed on Dec. 9, 2009, now Pat. No. 8,096,128.

(60) Provisional application No. 61/243,200, filed on Sep. 17, 2009.

(51) Int. Cl.
*F01K 25/02* (2006.01)

(52) U.S. Cl.
USPC ..... 60/660; 60/645; 60/655; 60/682

(58) Field of Classification Search
USPC ..... 60/645, 654, 655, 682–683, 660, 666, 60/667
See application file for complete search history.

(56) References Cited

U.S. PATENT DOCUMENTS 2,575,478 A 11/1951 Wilson
2,634,375 A 4/1953 Guimbal
(Continued)

FOREIGN PATENT DOCUMENTS

CA 2794150 9/2011
CN 202055876 U 11/2011
(Continued)

OTHER PUBLICATIONS

Y. Chen, P. Lundqvist, A. Johansson, P. Platell "A Comparative Study of the Carbon Dioxide Transcritical Power Cycle Compared with an Organic Rankine Cycle with R123 as Working Fluid in Waste Heat Recovery", Science Direct, Applied Thermal Engineering, 2006, 6 pages.

(Continued)

*Primary Examiner* — Hoang Nguyen
(74) *Attorney, Agent, or Firm* — Edmonds & Nolte, PC

(57) ABSTRACT

Various thermodynamic power-generating cycles employ a mass management system to regulate the pressure and amount of working fluid circulating throughout the working fluid circuits. The mass management systems may have a mass control tank fluidly coupled to the working fluid circuit at one or more strategically-located tie-in points. A heat exchanger coil may be used in conjunction with the mass control tank to regulate the temperature of the fluid within the mass control tank, and thereby determine whether working fluid is either extracted from or injected into the working fluid circuit. Regulating the pressure and amount of working fluid in the working fluid circuit helps selectively increase or decrease the suction pressure of the pump, which can increase system efficiency.

18 Claims, 14 Drawing Sheets

(56) References Cited

U.S. PATENT DOCUMENTS 2,691,280 A 10/1954 Albert
3,095,274 A 6/1963 Crawford
3,105,748 A 10/1963 Stahl
3,237,403 A 3/1966 Feher
3,277,955 A 10/1966 Heller
3,401,277 A 9/1968 Larson
3,622,767 A 11/1971 Koepcke
3,736,745 A 6/1973 Karig
3,772,879 A * 11/1973 Engdahl ..... 60/671
3,791,137 A 2/1974 Jubb
3,939,328 A 2/1976 Davis
3,971,211 A 7/1976 Wethe
3,982,379 A 9/1976 Gilli
3,998,058 A 12/1976 Park
4,009,575 A 3/1977 Hartman, Jr.
4,029,255 A 6/1977 Heiser
4,030,312 A 6/1977 Wallin
4,049,407 A 9/1977 Bottum
4,070,870 A 1/1978 Bahel
4,099,381 A 7/1978 Rappoport
4,119,140 A 10/1978 Cates
4,152,901 A 5/1979 Munters
4,164,848 A 8/1979 Gilli
4,164,849 A 8/1979 Mangus
4,182,960 A 1/1980 Reuyl
4,183,220 A 1/1980 Shaw
4,198,827 A 4/1980 Terry
4,208,882 A 6/1980 Lopes
4,221,185 A 9/1980 Scholes
4,233,085 A 11/1980 Roderick
4,248,049 A 2/1981 Briley
4,257,232 A 3/1981 Bell
4,287,430 A 9/1981 Guido
4,336,692 A 6/1982 Ecker
4,347,711 A 9/1982 Noe
4,347,714 A 9/1982 Kinsell
4,372,125 A 2/1983 Dickenson
4,384,568 A 5/1983 Palmatier
4,391,101 A 7/1983 Labbe
4,420,947 A 12/1983 Yoshino
4,428,190 A 1/1984 Bronicki
4,433,554 A 2/1984 Rojey
4,439,687 A 3/1984 Wood
4,439,994 A 4/1984 Briley
4,448,033 A 5/1984 Briccetti
4,450,363 A 5/1984 Russell
4,455,836 A 6/1984 Binstock
4,467,609 A 8/1984 Loomis
4,467,621 A 8/1984 O'brien
4,475,353 A 10/1984 Lazare
4,489,562 A 12/1984 Snyder
4,489,563 A 12/1984 Kalina
4,498,289 A 2/1985 Osgerby
4,516,403 A 5/1985 Tanaka
4,549,401 A 10/1985 Spliethoff
4,555,905 A 12/1985 Endou
4,558,228 A 12/1985 Larjola
4,573,321 A 3/1986 Knaebel
4,578,953 A 4/1986 Krieger
4,589,255 A 5/1986 Martens
4,636,578 A 1/1987 Feinberg
4,674,297 A 6/1987 Vobach
4,694,189 A 9/1987 Haraguchi
4,700,543 A 10/1987 Krieger
4,756,162 A 7/1988 Dayan
4,765,143 A 8/1988 Crawford
4,773,212 A 9/1988 Griffin
4,798,056 A 1/1989 Franklin
4,813,242 A 3/1989 Wicks
4,821,514 A 4/1989 Schmidt
4,986,071 A 1/1991 Voss
4,993,483 A 2/1991 Harris
5,000,003 A 3/1991 Wicks
5,050,375 A 9/1991 Dickinson
5,098,194 A 3/1992 Kuo
5,164,020 A 11/1992 Wagner
5,176,321 A 1/1993 Doherty
5,203,159 A 4/1993 Koizumi
5,228,310 A 7/1993 Vandenberg
5,291,960 A 3/1994 Brandenburg
5,335,510 A 8/1994 Rockenfeller
5,360,057 A 11/1994 Rockenfeller
5,392,606 A 2/1995 Labinov
5,440,882 A 8/1995 Kalina
5,444,972 A 8/1995 Moore
5,488,828 A 2/1996 Brossard
5,490,386 A 2/1996 Keller
5,503,222 A 4/1996 Dunne
5,531,073 A 7/1996 Bronicki
5,538,564 A 7/1996 Kaschmitter
5,542,203 A 8/1996 Luoma
5,570,578 A 11/1996 Saujet
5,588,298 A 12/1996 Kalina
5,600,967 A 2/1997 Meckler
5,647,221 A 7/1997 Garris, Jr.
5,649,426 A 7/1997 Kalina
5,680,753 A 10/1997 Hollinger
5,738,164 A 4/1998 Hildebrand
5,754,613 A 5/1998 Hashiguchi
5,771,700 A 6/1998 Cochran
5,789,822 A 8/1998 Calistrat
5,813,215 A 9/1998 Weisser
5,833,876 A 11/1998 Schnur
5,873,260 A 2/1999 Linhardt
5,874,039 A 2/1999 Edelson
5,894,836 A 4/1999 Wu
5,899,067 A 5/1999 Hageman
5,903,060 A 5/1999 Norton
5,918,460 A 7/1999 Connell
5,941,238 A 8/1999 Tracy
5,943,869 A 8/1999 Cheng
5,946,931 A 9/1999 Lomax
5,973,050 A 10/1999 Johnson
6,037,683 A 3/2000 Lulay
6,041,604 A 3/2000 Nicodemus
6,058,930 A 5/2000 Shingleton
6,062,815 A 5/2000 Holt
6,065,280 A 5/2000 Ranasinghe
6,066,797 A 5/2000 Toyomura
6,070,405 A 6/2000 Jerye
6,082,110 A 7/2000 Rosenblatt
6,105,368 A 8/2000 Hansen
6,112,547 A 9/2000 Spauschus
6,158,237 A 12/2000 Riffat
6,164,655 A 12/2000 Bothien
6,202,782 B1 3/2001 Hatanaka
6,223,846 B1 5/2001 Schechter
6,233,938 B1 5/2001 Nicodemus
6,282,900 B1 9/2001 Bell
6,282,917 B1 9/2001 Mongan
6,295,818 B1 10/2001 Ansley
6,299,690 B1 10/2001 Mongeon
6,341,781 B1 1/2002 Matz
6,374,630 B1 4/2002 Jones
6,393,851 B1 5/2002 Wightman
6,432,320 B1 8/2002 Bonsignore
6,434,955 B1 8/2002 Ng
6,442,951 B1 9/2002 Maeda
6,446,425 B1 9/2002 Lawlor
6,446,465 B1 9/2002 Dubar
6,463,730 B1 10/2002 Keller
6,484,490 B1 11/2002 Olsen
6,539,728 B2 4/2003 Korin
6,571,548 B1 6/2003 Bronicki
6,598,397 B2 * 7/2003 Hanna et al. ..... 60/651
6,644,062 B1 11/2003 Hays
6,657,849 B1 12/2003 Andresakis
6,668,554 B1 12/2003 Brown
6,684,625 B2 2/2004 Kline
6,695,974 B2 2/2004 Withers
6,715,294 B2 4/2004 Anderson
6,734,585 B2 5/2004 Tornquist
6,735,948 B1 5/2004 Kalina
6,739,142 B2 5/2004 Korin

(56) References Cited

U.S. PATENT DOCUMENTS 6,751,959 B1 6/2004 McClanahan
6,753,948 B2 6/2004 Taniguchi
6,769,256 B1 8/2004 Kalina
6,799,892 B2 10/2004 Leuthold
6,808,179 B1 10/2004 Bhattacharyya
6,810,335 B2 10/2004 Lysaght
6,817,185 B2 11/2004 Coney
6,857,268 B2 2/2005 Stinger
6,910,334 B2 6/2005 Kalina
6,918,254 B2 7/2005 Baker
6,921,518 B2 7/2005 Johnston
6,941,757 B2 9/2005 Kalina
6,960,839 B2 11/2005 Zimron
6,960,840 B2 11/2005 Willis
6,962,054 B1 11/2005 Linney
6,964,168 B1 11/2005 Pierson
6,968,690 B2 11/2005 Kalina
6,986,251 B2 1/2006 Radcliff
7,013,205 B1 3/2006 Hafner
7,021,060 B1 4/2006 Kalina
7,036,315 B2 5/2006 Kang
7,041,272 B2 5/2006 Keefer
7,047,744 B1 5/2006 Robertson
7,048,782 B1 5/2006 Couch
7,062,913 B2 6/2006 Christensen
7,096,665 B2 8/2006 Stinger
7,124,587 B1 10/2006 Linney
7,174,715 B2 2/2007 Armitage
7,194,863 B2 3/2007 Ganev
7,197,876 B1 4/2007 Kalina
7,200,996 B2 4/2007 Cogswell
7,234,314 B1 6/2007 Wiggs
7,249,588 B2 7/2007 Russell
7,278,267 B2 10/2007 Yamada
7,279,800 B2 10/2007 Bassett
7,287,381 B1 10/2007 Pierson
7,305,829 B2 12/2007 Mirolli
7,313,926 B2 1/2008 Gurin
7,340,897 B2 3/2008 Zimron
7,406,830 B2 8/2008 Valentian
7,416,137 B2 8/2008 Hagen
7,453,242 B2 11/2008 Ichinose
7,458,217 B2 12/2008 Kalina
7,458,218 B2 12/2008 Kalina
7,469,542 B2 12/2008 Kalina
7,516,619 B2 4/2009 Pelletier
7,621,133 B2 11/2009 Tomlinson
7,654,354 B1 2/2010 Otterstrom
7,665,291 B2 2/2010 Anand
7,665,304 B2 2/2010 Sundel
7,685,821 B2 3/2010 Kalina
7,730,713 B2 6/2010 Nakano
7,735,335 B2 6/2010 Uno
7,770,376 B1 8/2010 Brostmeyer
7,827,791 B2 11/2010 Pierson
7,838,470 B2 11/2010 Shaw
7,841,179 B2 11/2010 Kalina
7,841,306 B2 11/2010 Myers
7,854,587 B2 12/2010 Ito
7,866,157 B2 1/2011 Ernst
7,900,450 B2 3/2011 Gurin
7,950,230 B2 5/2011 Nishikawa
7,950,243 B2 5/2011 Gurin
7,972,529 B2 7/2011 Machado
8,096,128 B2 * 1/2012 Held et al. ..... 60/645
8,099,198 B2 1/2012 Gurin
8,146,360 B2 4/2012 Myers
8,281,593 B2 10/2012 Held
2001/0015061 A1 8/2001 Viteri
2001/0030404 A1 10/2001 Liu
2002/0029558 A1 3/2002 Tamaro
2002/0078696 A1 6/2002 Korin
2002/0078697 A1 6/2002 Lifson
2002/0082747 A1 6/2002 Kramer
2003/0000213 A1 1/2003 Christensen
2003/0061823 A1 4/2003 Alden
2003/0154718 A1 8/2003 Nayar
2003/0182946 A1 10/2003 Sami
2003/0213246 A1 * 11/2003 Coll et al. ..... 60/653
2003/0221438 A1 12/2003 Rane
2004/0011038 A1 1/2004 Stinger
2004/0011039 A1 1/2004 Stinger
2004/0020185 A1 2/2004 Brouillette
2004/0020206 A1 2/2004 Sullivan
2004/0035117 A1 2/2004 Rosen
2004/0083731 A1 5/2004 Lasker
2004/0083732 A1 5/2004 Hanna
2004/0097388 A1 5/2004 Brask
2004/0105980 A1 6/2004 Sudarshan
2004/0107700 A1 6/2004 McClanahan
2004/0159110 A1 8/2004 Janssen
2004/0211182 A1 10/2004 Gould
2005/0056001 A1 3/2005 Frutschi
2005/0109387 A1 5/2005 Marshall
2005/0137777 A1 6/2005 Kolavennu
2005/0162018 A1 7/2005 Realmuto
2005/0167169 A1 8/2005 Gering
2005/0183421 A1 8/2005 Vaynberg
2005/0196676 A1 9/2005 Singh
2005/0198959 A1 9/2005 Schubert
2005/0227187 A1 10/2005 Schilling
2005/0252235 A1 11/2005 Critoph
2005/0257812 A1 11/2005 Wright
2006/0010868 A1 1/2006 Smith
2006/0060333 A1 3/2006 Chordia
2006/0066113 A1 3/2006 Ebrahim et
2006/0080960 A1 4/2006 Rajendran
2006/0112693 A1 6/2006 Sundel
2006/0182680 A1 8/2006 Keefer
2006/0211871 A1 9/2006 Dai
2006/0213218 A1 9/2006 Uno
2006/0225459 A1 10/2006 Meyer
2006/0249020 A1 11/2006 Tonkovich
2006/0254281 A1 11/2006 Badeer
2007/0001766 A1 1/2007 Ripley
2007/0019708 A1 1/2007 Shiflett
2007/0027038 A1 2/2007 Kamimura
2007/0056290 A1 3/2007 Dahm
2007/0089449 A1 4/2007 Gurin
2007/0108200 A1 5/2007 McKinzie
2007/0119175 A1 5/2007 Ruggieri
2007/0130952 A1 6/2007 Copen
2007/0151244 A1 7/2007 Gurin
2007/0161095 A1 7/2007 Gurin
2007/0163261 A1 7/2007 Strathman
2007/0195152 A1 8/2007 Kawai
2007/0204620 A1 9/2007 Pronske
2007/0227472 A1 10/2007 Takeuchi
2007/0234722 A1 10/2007 Kalina
2007/0245733 A1 10/2007 Pierson
2007/0246206 A1 10/2007 Gong
2008/0006040 A1 1/2008 Peterson
2008/0010967 A1 1/2008 Griffin
2008/0023666 A1 1/2008 Gurin
2008/0053095 A1 3/2008 Kalina
2008/0066470 A1 3/2008 MacKnight
2008/0135253 A1 6/2008 Vinegar
2008/0173450 A1 7/2008 Goldberg
2008/0211230 A1 9/2008 Gurin
2008/0250789 A1 10/2008 Myers
2008/0252078 A1 10/2008 Myers
2009/0085709 A1 4/2009 Meinke
2009/0107144 A1 4/2009 Moghtaderi
2009/0139234 A1 6/2009 Gurin
2009/0139781 A1 6/2009 Straubel
2009/0173337 A1 7/2009 Tamaura
2009/0173486 A1 7/2009 Copeland
2009/0180903 A1 7/2009 Martin
2009/0205892 A1 8/2009 Jensen
2009/0211251 A1 8/2009 Petersen
2009/0266075 A1 10/2009 Westmeier
2009/0293503 A1 12/2009 Vandor
2010/0024421 A1 2/2010 Litwin
2010/0077792 A1 4/2010 Gurin

(56) References Cited

U.S. PATENT DOCUMENTS

| | | | |
|---|---|---|---|
| 2010/0083662 | A1 | 4/2010 | Kalina |
| 2010/0122533 | A1 | 5/2010 | Kalina |
| 2010/0146949 | A1 | 6/2010 | Stobart |
| 2010/0146973 | A1 | 6/2010 | Kalina |
| 2010/0156112 | A1 | 6/2010 | Held |
| 2010/0162721 | A1 | 7/2010 | Welch |
| 2010/0205962 | A1 | 8/2010 | Kalina |
| 2010/0218513 | A1 | 9/2010 | Vaisman |
| 2010/0218930 | A1 | 9/2010 | Proeschel |
| 2010/0263380 | A1 | 10/2010 | Biederman |
| 2010/0300093 | A1 | 12/2010 | Doty |
| 2010/0326076 | A1 | 12/2010 | Ast |
| 2011/0030404 | A1 | 2/2011 | Gurin |
| 2011/0048012 | A1 | 3/2011 | Ernst |
| 2011/0061384 | A1 | 3/2011 | Held |
| 2011/0061387 | A1 | 3/2011 | Held |
| 2011/0088399 | A1 | 4/2011 | Briesch |
| 2011/0179799 | A1 | 7/2011 | Allam |
| 2011/0185729 | A1 | 8/2011 | Held |
| 2011/0192163 | A1 | 8/2011 | Kasuya |
| 2012/0047892 | A1 | 3/2012 | Held |
| 2012/0067055 | A1 | 3/2012 | Held |
| 2012/0128463 | A1 | 5/2012 | Held |
| 2012/0131918 | A1 | 5/2012 | Held |
| 2012/0131919 | A1 | 5/2012 | Held |
| 2012/0131920 | A1 | 5/2012 | Held |
| 2012/0131921 | A1 | 5/2012 | Held |
| 2012/0247134 | A1 | 10/2012 | Gurin |
| 2012/0247455 | A1 | 10/2012 | Gurin |
| 2013/0033037 | A1 | 2/2013 | Held |
| 2013/0036736 | A1 | 2/2013 | Hart |
| 2013/0113221 | A1 | 5/2013 | Held |

FOREIGN PATENT DOCUMENTS

| | | | |
|---|---|---|---|
| CN | 202544943 | U | 11/2012 |
| CN | 202718721 | U | 2/2013 |
| DE | 19906087 | | 8/2000 |
| DE | 10052993 | | 5/2002 |
| EP | 1977174 (A2) | | 10/2008 |
| EP | 2419621 | | 2/2012 |
| EP | 2446122 | | 5/2012 |
| EP | 2478201 | | 7/2012 |
| EP | 2500530 | | 9/2012 |
| EP | 2550436 | | 1/2013 |
| GB | 856985 | | 12/1960 |
| GB | 2075608 | | 11/1981 |
| JP | 58-193051 | | 11/1983 |
| JP | 61152914 | | 7/1986 |
| JP | 01240705 | | 9/1989 |
| JP | 05-321612 | | 7/1993 |
| JP | 06-331225 | | 11/1994 |
| JP | 09-100702 | A2 | 4/1997 |
| JP | 2641581 | B2 | 5/1997 |
| JP | 09-209716 | A | 8/1997 |
| JP | 2858750 | B2 | 12/1998 |
| JP | 2001-193419 | A2 | 7/2001 |
| JP | 2002-097965 | A2 | 4/2002 |
| JP | 2004-239250 | A2 | 8/2004 |
| JP | 2004-332626 | A2 | 11/2004 |
| JP | 2005533972 | | 11/2005 |
| JP | 2007198200 | | 8/2007 |
| JP | 4343738 | B2 | 7/2009 |
| JP | 2011-017268 | A2 | 1/2011 |
| KR | 100191080 | | 6/1999 |
| KR | 0766101 | B1 | 10/2007 |
| KR | 100844634 | | 7/2008 |
| KR | 1069914 | B1 | 9/2011 |
| KR | 1103549 | B1 | 1/2012 |
| KR | 2012-0058582 | | 6/2012 |
| KR | 2012-0068670 | | 6/2012 |
| KR | 2012-0128753 | | 6/2012 |
| KR | 2012-0128755 | | 11/2012 |
| WO | WO91/05145 | | 4/1991 |
| WO | WO96/09500 | | 3/1996 |
| WO | WO01/44658 | | 6/2001 |
| WO | WO2006/137957 | | 12/2006 |
| WO | WO2007/056241 | | 5/2007 |
| WO | WO2007/079245 | | 7/2007 |
| WO | WO2007/082103 | | 7/2007 |
| WO | WO2008/039725 | | 4/2008 |
| WO | 2009045196 | | 4/2009 |
| WO | 2010784173 | | 7/2010 |
| WO | WO2010/074173 | | 7/2010 |
| WO | WO2010/121255 | | 10/2010 |
| WO | WO2010/126980 | | 11/2010 |
| WO | WO2010/151560 | | 12/2010 |
| WO | WO2011/017450 | | 2/2011 |
| WO | WO2011/017476 | | 2/2011 |
| WO | WO2011/017599 | | 2/2011 |
| WO | 2011034984 | | 3/2011 |
| WO | WO2011/062204 | | 5/2011 |
| WO | WO2011/094294 | | 8/2011 |
| WO | WO2011/119650 | | 9/2011 |
| WO | 2012074905 | | 6/2012 |
| WO | 2012074911 | | 6/2012 |
| WO | WO 2012/074907(A2) | | 6/2012 |
| WO | WO 2012/074940 | | 6/2012 |
| WO | WO2013/059687 | | 4/2013 |
| WO | WO2013/059695 | | 4/2013 |
| WO | WO2013/055391 | | 5/2013 |
| WO | WO2013/749407 | | 5/2013 |

OTHER PUBLICATIONS

Vaclav Dostal, Martin Kulhanek, "Research on the Supercritical Carbon Dioxide Cycles in the Czech Republic", Department of Fluid Mechanics and Power Engineering Czech Technical University in Prague, RPI, Troy, NY, Apr. 29-30, 2009; 8 pages.

PCT/US2010/049042—International Search Report and Written Opinion dated Nov. 17, 2010.

PCT/US2011/029486—International Search Report and Written Opinion dated Nov. 16, 2011.

PCT/US2010/049042—International Preliminary Report on Patentability dated Mar. 29, 2012.

PCT/US2011/062201—International Search Report and Written Opinion dated Jun. 26, 2012.

PCT/US2011/062207—International Search Report and Written Opinion dated Jun. 28, 2012.

PCT/US2011/062198—International Search Report and Written Opinion dated Jul. 2, 2012.

PCT/US2011/062266—International Search Report and Written Opinion dated Jul. 9, 2012.

PCT/US2011/029486—International Preliminary Report on Patentability dated Sep. 25, 2012.

PCT/US2012/062204—International Search Report and Written Opinion dated Nov. 1, 2012.

PCT/US2010/031614—International Preliminary Report on Patentability dated Oct. 27, 2011.

PCT/US2010/044681—International Search Report and Written Opinion mailed Oct. 7, 2010.

Alpy, N., et al., "French Atomic Energy Commission views as regards SCO2 Cycle Development priorities and related R&D approach" Symposium on SCO2 Power Cycles, Apr. 29-30, 2009, Troy, NY, 20 pages.

Angelino, G., and Invernizzi, C.M., "Carbon Dioxide Power Cycles using Liquid Natural Gas as Heat Sink", Applied Thermal Engineering Mar. 3, 2009, 43 pages.

Bryant, John C., Saari, Henry, and Zanganeh, Kourosh, "An Analysis and Comparison of the Simple and Recompression Supercritical CO2 Cycles" Supercritical CO2 Power Cycle Symposium, May 24-25, 2011, Boulder, CO, 8 pages.

Chapman, Daniel J., Arias, Diego A., "An Assessment of the Supercritical Carbon Dioxide Cycle for Use in a Solar Parabolic Trough Power Plant", Abengoa Solar, Apr. 29-30, 2009, Troy, NY, 20 pages.

Chapman, Daniel J., Arias, Diego A., "An Assessment of the Supercritical Carbon Dioxide Cycle for Use in a Solar Parabolic Trough Power Plant", Abengoa Solar, Apr. 29-30, 2009, Troy, NY, 5 pages.

(56) References Cited

OTHER PUBLICATIONS

Chen, Yang, "Thermodynamic Cycles Using Carbon Dioxide as Working Fluid", Doctoral Thesis, School of Industrial Engineering and Management, Stockholm, Oct. 2011, 150 pages.
Chordia, Lalit, "Optimizing Equipment for Supercritical Applications", Thar Energy LLC, Supercritical CO2 Power Cycle Symposium, May 24-25, 2011, Boulder, CO, 7 pages.
Combs, Osie V., "An Investigation of the Supercritical CO2 Cycle (Feher cycle) for Shipboard Application", Massachusetts Institute of Technology, May 1977, 290 pages.
Di Bella, Francis A., "Gas Turbine Engine Exhaust Waste Heat Recovery Navy Shipboard Module Development", Supercritical CO2 Power Cycle Symposium, May 24-25, 2011, Boulder, CO, 8 pages.
Dostal, V., et al., A Supercritical Carbon Dioxide Cycle for Next Generation Nuclear Reactors, Mar. 10, 2004, 326 pages.
Dostal, Vaclav and Kulhanek, Martin, "Research on the Supercritical Carbon Dioxide Cycles in the Czech Republic", Czech Technical University in Prague, Symposium on SCO2 Power Cycles, Apr. 29-30, 2009, Troy, NY, 8 pages.
Dostal, Vaclav, and Dostal, Jan, "Supercritical CO2 Regeneration Bypass Cycle—Comparison to Traditional Layouts", Supercritical CO2 Power Cycle Symposium, May 24-25, 2011, Boulder, CO, 8 pages.
Eisemann, Kevin, and Fuller, Robert L., "Supercritical CO2 Brayton Cycle Design and System Start-up Options", Barber Nichols, Inc., Presentation, Supercritical CO2 Power Cycle Symposium, May 24-25, 2011, Boulder, CO, 7 pages.
Eisemann, Kevin, and Fuller, Robert L., "Supercritical CO2 Brayton Cycle Design and System Start-up Options", Supercritical CO2 Power Cycle Symposium, May 24-25, 2011, Boulder, CO, 7 pages.
Feher, E.G., et al., "Investigation of Supercritical (Feher) Cycle", Astropower Laboratory, Missile & Space Systems Division, Oct. 1968, 152 pages.
Fuller, Robert L., and Eisemann, Kevin, "Centrifugal Compressor Off-Design Performance for Super-Critical CO2", Barber Nichols, Inc. Presentation, Supercritical CO2 Power Cycle Symposium, May 24-25, 2011, Boulder, CO, 20 pages.
Fuller, Robert L., and Eisemann, Kevin, "Centrifugal Compressor Off-Design Performance for Super-Critical CO2" Supercritical CO2 Power Cycle Symposium, May 24-25, 2011, Boulder, CO, 12 pages.
Gokhstein, D.P. and Verkhivker, G.P. "Use of Carbon Dioxide as a Heat Carrier and Working Substance in Atomic Power Stations", Soviet Atomic Energy, Apr. 1969, vol. 26, Issue 4, pp. 430-432.
Gokhstein, D.P.; Taubman, E.I.; Konyaeva, G.P., "Thermodynamic Cycles of Carbon Dioxide Plant with an Additional Turbine After the Regenerator", Energy Citations Database, Mar. 1973, (1 page, Abstract only).
Hejzlar, P. et al., "Assessment of Gas Cooled Gas Reactor with Indirect Supercritical CO2 Cycle" Massachusetts Institute of Technology, Jan. 2006, 10 pages.
Hoffman, John R., and Feher, E.G., "150 kwe Supercritical Closed Cycle System", Transactions of the ASME, Jan. 1971, pp. 70-80.
Jeong, Woo Seok, et al., "Performance of S-CO2 Brayton Cycle with Additive Gases for SFR Application", Korea Advanced Institute of Science and Technology, Supercritical CO2 Power Cycle Symposium, May 24-25, 2011, Boulder, CO, 5 pages.
Johnson, Gregory A., & McDowell, Michael, "Issue Associated with Coupling Supercritical CO2 Power Cycles to Nuclear, Solar and Fossil Fuel Heat Sources", Hamilton Sundstrand, Energy Space & Defense-Rocketdyne, Apr. 29-30, 2009, Troy, NY, Presentation, 18 pages.
Kawakubo, Tomoki, "Unsteady Roto-Stator Interaction of a Radial-Inflow Turbine with Variable Nozzle Vanes", ASME Turbo Expo 2010: Power for Land, Sea, and Air; vol. 7: Turbomachinery, Parts A, B, and C; Glasgow, UK, Jun. 14-18, 2010, Paper No. GT2010-23677, pp. 2075-2084, (1 page, Abstract only).
Kulhanek, Martin, "Thermodynamic Analysis and Comparison of S-CO2 Cycles" Czech Technical University in Prague, Supercritical CO2 Power Cycle Symposium, May 24-25, 2011, Boulder, CO, 14 pages.
Kulhanek, Martin, "Thermodynamic Analysis and Comparison of S-CO2 Cycles", Czech Technical University in Prague, Supercritical CO2 Power Cycle Symposium, May 24-25, 2011, Boulder, CO, 7 pages.
Kulhanek, Martin., and Dostal, Vaclav, "Supercritical Carbon Dioxide Cycles Thermodynamic Analysis and Comparison", Abstract, Faculty Conference held in Prague, Mar. 24, 2009, 13 pages.
Ma, Zhiwen and Turchi, Craig S., "Advanced Supercritical Carbon Dioxide Power Cycle Configurations for Use in Concentrating Solar Power Systems", National Renewable Energy Laboratory, Supercritical CO2 Power Cycle Symposium, May 24-25, 2011, Boulder, CO, 4 pages.
Moisseytsev, Anton, and Sienicki, Jim, "Investigation of Alternative Layouts for the Supercritical Carbon Dioxide Brayton Cycle for a Sodium-Cooled Fast Reactor", Supercritical CO2 Power Cycle Symposium, Troy, NY, Apr. 29, 2009, 26 pages.
Munoz De Escalona, Jose M., "The Potential of the Supercritical Carbon Dioxide Cycle in High Temperature Fuel Cell Hybrid Systems", Thermal Power Group, University of Seville, Supercritical CO2 Power Cycle Symposium, May 24-25, 2011, Boulder, CO, 6 pages.
Munoz De Escalona, Jose M., et al., "The Potential of the Supercritical Carbon Dioxide Cycle in High Temperature Fuel Cell Hybrid Systems", Thermal Power Group, University of Seville, Supercritical CO2 Power Cycle Symposium, May 24-25, 2011, Boulder, CO, 19 pages.
Muto, Y., et al., "Application of Supercritical CO2 Gas Turbine for the Fossil Fired Thermal Plant", Journal of Energy and Power Engineering, Sep. 30, 2010, vol. 4, No. 9, 9 pages.
Muto, Yasushi, and Kato, Yasuyoshi, "Optimal Cycle Scheme of Direct Cycle Supercritical CO2 Gas Turbine for Nuclear Power Generation Systems", International Conference on Power Engineering-2007, Oct. 23-27, 2007, Hangzhou, China, pp. 86-87.
Noriega, Bahamonde J.S., "Design Method for s-CO2 Gas Turbine Power Plants", Master of Science Thesis, Delft University of Technology, Oct. 2012, 122 pages.
Oh, Chang, et al., "Development of a Supercritical Carbon Dioxide Brayton Cycle: Improving PBR Efficiency and Testing Material Compatibility" Nuclear Energy Research Initiative Report, Oct. 2004, 38 pages.
Oh, Chang; et al., "Development of a Supercritical Carbon Dioxide Brayton Cycle: Improving VHTR Efficiency and Testing Material Compatibility" Nuclear Energy Research Initiative Report, Final Report, Mar. 2006, 97 pages.
Parma, Ed, et al., "Supercritical CO2 Direct Cycle Gas Fast Reactor (SC-GFR) Concept" Presentation for Supercritical CO2 Power Cycle Symposium, May 24-25, 2011, Boulder, CO, 40 pages.
Parma, Ed, et al., "Supercritical CO2 Direct Cycle Gas Fast Reactor (SC-GFR) Concept", Supercritical CO2 Power Cycle Symposium, May 24-25, 2011, Boulder, CO, 9 pages.
Parma, Edward J., et al., "Supercritical CO2 Direct Cycle Gas Fast Reactor (SC-GFR) Concept" Sandia National Laboratories, May 2011, 55 pages.
PCT/US2006/049623—Written Opinion of ISA dated Jan. 4, 2008, 4 pages.
PCT/US2007/001120—International Search Report dated Apr. 25, 2008, 5 pages.
PCT/US2007/079318—International Preliminary Report on Patentability dated Jul. 7, 2008, 5 pages.
PCT/US2010/039559—International Preliminary Report on Patentability dated Jan. 12, 2012, 7 pages.
PCT/US2010/044476—WO Publication and International Search Report dated Sep. 29, 2010, 52 pages.
PCT/US2010/044681—International Preliminary Report on Patentability dated Feb. 16, 2012, 9 pages.
PCT/US2010/31614—International Search Report dated Jul. 12, 2010, 24 pages.
PCT/US2011/062204—International Search Report dated Nov. 1, 2012, 10 pages.

(56) References Cited

OTHER PUBLICATIONS

PCT/US2012/000470—International Search Report dated Mar. 8, 2013, 10 pages.
PCT/US2012/061151—International Search Report and Written Opinion dated Feb. 25, 2013, 9 pages.
PCT/US2012/061159—WO Publication and International Search Report dated Mar. 2, 2013, 22 pages.
Persichilli, Michael, et al., "Supercritical CO2 Power Cycle Developments and Commercialization: Why sCO2 can Displace Steam" Echogen Power Systems LLC, Power-Gen India & Central Asia 2012, Apr. 19-21, 2012, New Delhi, India, 15 pages.
Saari, Henry, et al., "Supercritical CO2 Advanced Brayton Cycle Design", Carleton University, Supercritical CO2 Power Cycle Symposium, May 24-25, 2011, Boulder, CO, 21 pages.
San Andres, Luis, "Start-Up Response of Fluid Film Lubricated Cryogenic Turbopumps (Preprint)", AIAA/ASME/SAE/ASEE Joint Propulsion Conference, Cincinnati, OH, Jul. 8-11, 2007, 38 pages.
Sarkar, J., and Bhattacharyya, Souvik, "Optimization of Recompression S-CO2 Power Cycle with Reheating" Energy Conversion and Management 50 (May 17, 2009), pp. 1939-1945.
Tom, Samsun Kwok Sun, "The Feasibility of Using Supercritical Carbon Dioxide as a Coolant for the Candu Reactor", The University of British Columbia, Jan. 1978, 156 pages.
VGB PowerTech Service GmbH, "CO2 Capture and Storage", A VGB Report on the State of the Art, Aug. 25, 2004, 112 pages.
Vidhi, Rachana, et al., "Study of Supercritical Carbon Dioxide Power Cycle for Power Conversion from Low Grade Heat Sources", University of South Florida and Oak Ridge National Laboratory, Supercritical CO2 Power Cycle Symposium, May 24-25, 2011, Boulder, CO, 17 pages.
Vidhi, Rachana, et al., "Study of Supercritical Carbon Dioxide Power Cycle for Power Conversion from Low Grade Heat Sources", University of South Florida and Oak Ridge National Laboratory, Supercritical CO2 Power Cycle Symposium, May 24-25, 2011, Boulder, CO, 8 pages.
Wright, Steven A., et al., "Modeling and Experimental Results for Condensing Supercritical CO2 Power Cycles", Sandia Report, Jan. 2011, 47 pages.
Wright, Steven A., et al., "Supercritical CO2 Power Cycle Development Summary at Sandia National Laboratories", May 24-25, 2011, (1 page, Abstract only).
Wright, Steven, "Mighty Mite", Mechanical Engineering, Jan. 2012, pp. 41-43.
Yoon, Ho Joon, et al., "Preliminary Results of Optimal Pressure Ratio for Supercritical CO2 Brayton Cycle coupled with Small Modular Water Cooled Reactor" Korea Advanced Institute of Science and Technology and Khalifa University of Science, Technology and Research, Boulder, CO, May 25, 2011, 18 Pages.
Yoon, Ho Joon, et al., "Preliminary Results of Optimal Pressure Ratio for Supercritical CO2 Brayton Cycle coupled with Small Modular Water Cooled Reactor", Korea Advanced Institute of Science and Technology and Khalifa University of Science, Technology and Research, May 24-25, 2011, Boulder, CO, 7 Pages.

* cited by examiner

HEAT ENGINE AND HEAT TO ELECTRICITY SYSTEMS AND METHODS WITH WORKING FLUID MASS MANAGEMENT CONTROL

CROSS-REFERENCE TO RELATED APPLICATIONS

This application is continuation-in-part of U.S. patent application Ser. No. 12/631,379, entitled "Heat Engine and Heat to Electricity Systems and Methods," and filed Dec. 4, 2009, now issued as U.S. Pat. No. 8,096,128, which claims benefit of U.S. Provisional Application Ser. No. 61/243,200, filed on Sep. 17, 2009, the contents of which are both hereby incorporated by reference to the extent not inconsistent with the present disclosure.

BACKGROUND

Heat is often created as a byproduct of industrial processes where flowing streams of liquids, solids or gasses that contain heat must be exhausted into the environment or removed in some way in an effort to maintain the operating temperatures of the industrial process equipment. Sometimes the industrial process can use heat exchanger devices to capture the heat and recycle it back into the process via other process streams. Other times it is not feasible to capture and recycle this heat because it is either too high in temperature or it may contain insufficient mass flow. This heat is referred to as "waste" heat and is typically discharged directly into the environment or indirectly through a cooling medium, such as water.

Waste heat can be utilized by turbine generator systems that employ well-known thermodynamic methods, such as the Rankine cycle, to convert the heat into useful work. Typically, this method is a steam-based process where the waste heat is used to generate steam in a boiler in order to drive a turbine. The steam-based Rankine cycle, however, is not always practical because it requires heat source streams that are relatively high in temperature (e.g., 600° F. or higher) or are large in overall heat content. Moreover, the complexity of boiling water at multiple pressures/temperatures to capture heat at multiple temperature levels as the heat source stream is cooled, is costly in both equipment cost and operating labor. Consequently, the steam-based Rankine cycle is not a realistic option for streams of small flow rate and/or low temperature.

The organic Rankine cycle (ORC) addresses some of these issues by replacing water with a lower boiling-point fluid, such as a light hydrocarbon like propane or butane, or a HFC (e.g., R245fa) fluid. However, the boiling heat transfer restrictions remain, and new issues such as thermal instability, toxicity or flammability of the fluid are added.

There exists a need in the art for a system that can efficiently and effectively produce power from not only waste heat but also from a wide range of thermal sources.

SUMMARY

Embodiments of the disclosure may provide a heat engine system for converting thermal energy into mechanical energy. The heat engine may include a working fluid circuit that circulates a working fluid through a high pressure side and a low pressure side of the working fluid circuit, and a mass management system fluidly coupled to the working fluid circuit and configured to regulate a pressure and an amount of working fluid within the working fluid circuit. The working fluid circuit may include a first heat exchanger in thermal communication with a heat source to transfer thermal energy to the working fluid, a first expander in fluid communication with the first heat exchanger and fluidly arranged between the high and low pressure sides, and a first recuperator fluidly coupled to the first expander and configured to transfer thermal energy between the high and low pressure sides. The working fluid circuit may also include a cooler in fluid communication with the first recuperator and configured to control a temperature of the working fluid in the low pressure side, and a first pump fluidly coupled to the cooler and configured to circulate the working fluid through the working fluid circuit. The mass management system may include a mass control tank fluidly coupled to the high pressure side at a first tie-in point located upstream from the first expansion device and to the low pressure side at a second tie-in point located upstream from an inlet of the pump, and a control system communicably coupled to the working fluid circuit at a first sensor set arranged before the inlet of the pump and at a second sensor set arranged after an outlet of the pump, and communicably coupled to the mass control tank at a third sensor set arranged either within or adjacent the mass control tank.

Embodiments of the disclosure may further provide a method for regulating a pressure and an amount of a working fluid in a thermodynamic cycle. The method may include placing a thermal energy source in thermal communication with a heat exchanger arranged within a working fluid circuit, the working fluid circuit having a high pressure side and a low pressure side, and circulating the working fluid through the working fluid circuit with a pump. The method may also include expanding the working fluid in an expander to generate mechanical energy, and sensing operating parameters of the working fluid circuit with first and second sensor sets communicably coupled to a control system, the first sensor set being arranged adjacent an inlet of the pump and the second sensor set being arranged adjacent an outlet of the pump. The method may further include extracting working fluid from the working fluid circuit at a first tie-in point arranged upstream from the expander in the high pressure side, the first tie-in point being fluidly coupled to a mass control tank, and injecting working fluid from the mass control tank into the working fluid circuit via a second tie-in point arranged upstream from an inlet of the pump to increase a suction pressure of the pump.

Embodiments of the disclosure may further provide another method for regulating a pressure and an amount of a working fluid in a thermodynamic cycle. The method may include placing a thermal energy source in thermal communication with a heat exchanger arranged within a working fluid circuit, the working fluid circuit having a high pressure side and a low pressure side, and circulating the working fluid through the working fluid circuit with a pump. The method may also include expanding the working fluid in an expander to generate mechanical energy, and extracting working fluid from the working fluid circuit and into a mass control tank by transferring thermal energy from working fluid in the mass control tank to a heat exchanger coil, the working fluid being extracted from the working fluid circuit at a first tie-in point arranged upstream from the expander in the high pressure side and being fluidly coupled to the mass control tank. The method may further include injecting working fluid from the mass control tank to the working fluid circuit via a second tie-in point by transferring thermal energy from the heat exchanger coil to the working fluid in the mass control tank.

Embodiments of the disclosure may further provide a mass management system. The mass management system may include a mass control tank fluidly coupled to a low pressure side of a working fluid circuit that has a pump configured to circulate a working fluid throughout the working fluid circuit, the mass control tank being coupled to the low pressure side at a tie-in point located upstream from an inlet of the pump. The mass management system may also include a heat exchanger configured to transfer heat to and from the mass control tank to either draw in working fluid from the working fluid circuit and to the mass control tank via the tie-in point or inject working fluid into the working fluid circuit from the mass control tank via the tie-in point. The mass management system may further include a control system communicably coupled to the working fluid circuit at a first sensor set arranged adjacent the inlet of the pump and a second sensor set arranged adjacent an outlet of the pump, and communicably coupled to the mass control tank at a third sensor set arranged either within or adjacent the mass control tank.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1A:
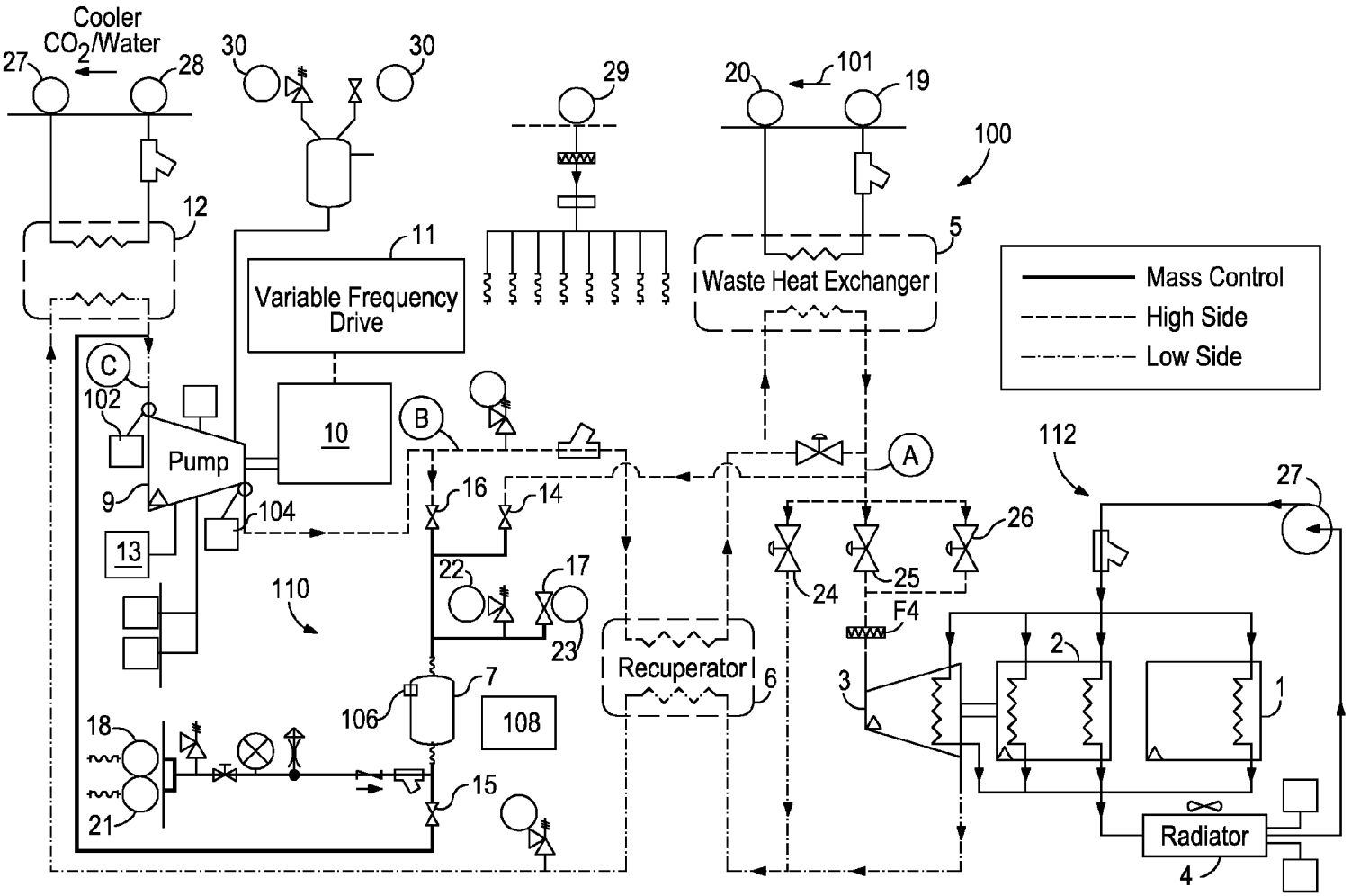
FIG. 1A is a schematic diagram of a heat to electricity system including a working fluid circuit, according to one or more embodiments disclosed.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

FIG. 1A illustrates an exemplary heat engine system 100, according to one or more embodiments described. The heat engine system 100 may also be referred to as a thermal engine, a power generation device, a heat or waste heat recovery system, and/or a heat to electricity system. The system 100 may encompass one or more elements of a Rankine thermodynamic cycle configured to circulate a working fluid through a working fluid circuit to produce power from a wide range of thermal sources. The terms "thermal engine" or "heat engine" as used herein generally refer to the equipment set that executes the thermodynamic cycles described herein. The term "heat recovery system" generally refers to the thermal engine in cooperation with other equipment to deliver/remove heat to and from the thermal engine.

As will be described in greater detail below, the thermodynamic cycle may operate as a closed-loop cycle, where a working fluid circuit has a flow path defined by a variety of conduits adapted to interconnect the various components of the system 100. Although the system 100 may be characterized as a closed-loop cycle, the system 100 as a whole may or may not be hermetically-sealed such that no amount of working fluid is leaked into the surrounding environment.

As illustrated, the heat engine system 100 may include a waste heat exchanger 5 in thermal communication with a waste heat source 101 via connection points 19 and 20. The waste heat source 101 may be a waste heat stream such as, but not limited to, gas turbine exhaust, process stream exhaust, or other combustion product exhaust streams, such as furnace or boiler exhaust streams. In other embodiments, the waste heat source 101 may include renewable sources of thermal energy, such as heat from the sun or geothermal sources. Accordingly, waste heat is transformed into electricity for applications ranging from bottom cycling in gas turbines, stationary diesel engine gensets, industrial waste heat recovery (e.g., in refineries and compression stations), solar thermal, geothermal, and hybrid alternatives to the internal combustion engine.

A turbine or expander 3 may be arranged downstream from the waste heat exchanger 5 and be configured to receive and expand a heated working fluid discharged from the heat exchanger 5 to generate power. To this end, the expander 3 may be coupled to an alternator 2 adapted to receive mechanical work from the expander 3 and convert that work into electrical power. The alternator 2 may be operably connected to power electronics 1 configured to convert the electrical power into useful electricity. In one embodiment, the alternator 2 may be in fluid communication with a cooling loop 112 having a radiator 4 and a pump 27 for circulating a cooling fluid such as water, thermal oils, and/or other suitable refrigerants. The cooling loop 112 may be configured to regulate the temperature of the alternator 2 and power electronics 1 by circulating the cooling fluid.

A recuperator 6 may be fluidly coupled to the expander 3 and configured to remove at least a portion of the thermal energy in the working fluid discharged from the expander 3. The recuperator 6 may transmit the removed thermal energy to the working fluid proceeding toward the waste heat exchanger 5. A condenser or cooler 12 may be fluidly coupled to the recuperator 6 and configured to reduce the temperature of the working fluid even more. The recuperator 6 and cooler 12 may be any device adapted to reduce the temperature of the working fluid such as, but not limited to, a direct contact heat exchanger, a trim cooler, a mechanical refrigeration unit, and/or any combination thereof. In at least one embodiment, the waste heat exchanger 5, recuperator 6, and/or the cooler 12 may include or employ one or more printed circuit heat exchange panels. Such heat exchangers and/or panels are known in the art, and are described in U.S. Pat. Nos. 6,921,518; 7,022,294; and 7,033,553, the contents of which are incorporated by reference to the extent consistent with the present disclosure.

The cooler 12 may be fluidly coupled to a pump 9 that receives the cooled working fluid and pressurizes the fluid circuit to re-circulate the working fluid back to the waste heat exchanger 5. In one embodiment, the pump 9 may be driven by a motor 10 via a common rotatable shaft. The speed of the motor 10, and therefore the pump 9, may be regulated using a variable frequency drive 11. As can be appreciated, the speed of the pump 9 may control the mass flow rate of the working fluid in the fluid circuit of the system 100.

In other embodiments, the pump 9 may be powered externally by another device, such as an auxiliary expansion device 13. The auxiliary expansion device 13 may be an expander or turbine configured to expand a working fluid and provide mechanical rotation to the pump 9. In at least one embodiment, the auxiliary expansion device 13 may expand a portion of the working fluid circulating in the working fluid circuit.

As indicated, the working fluid may be circulated through a "high pressure" side of the fluid circuit of the system 100 and a "low pressure" side thereof. The high pressure side generally encompasses the conduits and related components of the system 100 extending from the outlet of the pump 9 to the inlet of the turbine 3. The low pressure side of the system 100 generally encompasses the conduits and related components of the system 100 extending from the outlet of the expander 3 to the inlet of the pump 9.

In one or more embodiments, the working fluid used in the thermal engine system 100 may be carbon dioxide ($CO_2$). It should be noted that the use of the term carbon dioxide is not intended to be limited to $CO_2$ of any particular type, purity, or grade. For example, industrial grade $CO_2$ may be used without departing from the scope of the disclosure. Carbon dioxide is a neutral working fluid that offers benefits such as non-toxicity, non-flammability, easy availability, thermal stability, and low price.

In other embodiments, the working fluid may be a binary, ternary, or other working fluid blend. The working fluid combination can be selected for the unique attributes possessed by the fluid combination within a heat recovery system, as described herein. For example, one such fluid combination includes a liquid absorbent and $CO_2$ mixture enabling the combined fluid to be pumped in a liquid state to high pressure with less energy input than required to compress $CO_2$. In another embodiment, the working fluid may be a combination of $CO_2$ and one or more other miscible fluids. In other embodiments, the working fluid may be a combination of $CO_2$ and propane, or $CO_2$ and ammonia, without departing from the scope of the disclosure.

Moreover, the term "working fluid" is not intended to limit the state or phase of matter that the working fluid is in. For example, the working fluid may be in a fluid phase, a gas phase, a supercritical phase, a subcritical state or any other phase or state at any one or more points within the system 100 or thermodynamic cycle. In one or more embodiments, the working fluid is in a supercritical state over certain portions of the system 100 (i.e., the "high pressure side"), and in a subcritical state at other portions of the system 100 (i.e., the "low pressure side"). In other embodiments, the entire thermodynamic cycle, including both the high and low pressure sides, may be operated such that the working fluid is maintained in a supercritical or subcritical state throughout the entire working fluid circuit of the system 100.

Figure 2:
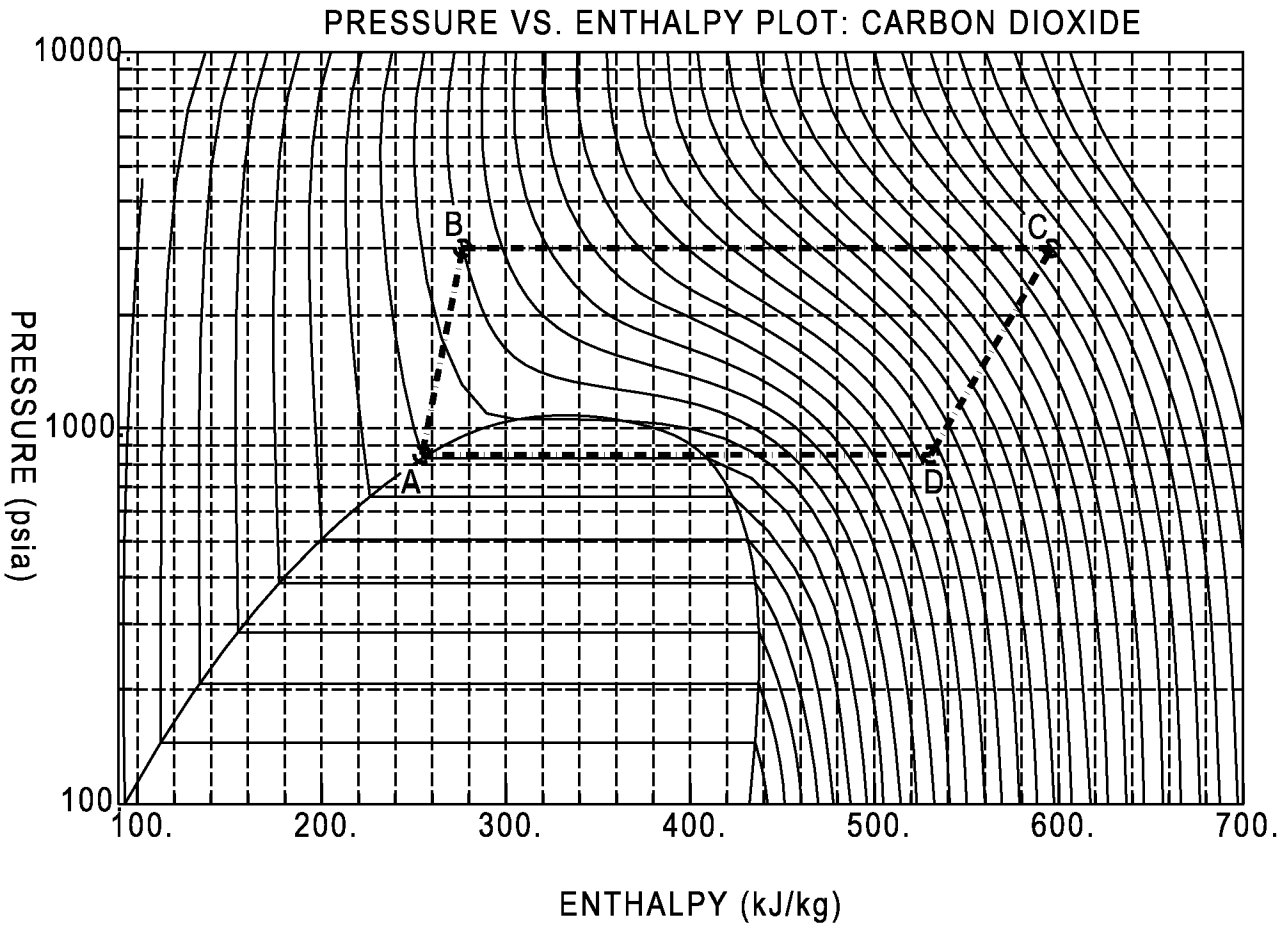
FIG. 2 is a pressure-enthalpy diagram for carbon dioxide.

The thermodynamic cycle(s) executed by the heat engine system 100 may be described with reference to a pressure-enthalpy diagram 200 for a selected working fluid. For example, the diagram 200 in FIG. 2 provides the general pressure versus enthalpy for carbon dioxide. At point A, the working fluid exhibits its lowest pressure and lowest enthalpy relative to its state at any other point during the cycle. As the working fluid is compressed or otherwise pumped to a higher pressure, its state moves to point B on the diagram 200. As thermal energy is introduced to the working fluid, both the temperature and enthalpy of the working fluid increase until reaching point C on the diagram 200. The working fluid is then expanded through one or more mechanical processes to point D. As the working fluid discharges heat, its temperature and enthalpy are simultaneously reduced until returning to point A.

As will be appreciated, each process (i.e., A-B, B-C, C-D, D-A) need not occur as shown on the exemplary diagram 200, instead each step of the cycle could be achieved via a variety of ways. For example, those skilled in the art will recognize that it is possible to achieve a variety of different coordinates on the diagram 200 without departing from the scope of the disclosure. Similarly, each point on the diagram 200 may vary dynamically over time as variables within and external to the system 100 (FIG. 1A) change, i.e., ambient temperature, waste heat temperature, amount of mass (i.e., working fluid) in the system, combinations thereof, etc.

In one embodiment, the thermodynamic cycle is executed during normal, steady state operation such that the low pressure side of the system 100 (points A and D in the diagram 200) falls between about 400 psia and about 1500 psia, and the high pressure side of the system 100 (points B and C in the diagram 200) falls between about 2500 psia and about 4500 psia. Those skilled in the art will also readily recognize that either or both higher or lower pressures could be selected for each or all points A-D. In at least one embodiment, the working fluid may transition from a supercritical state to a subcritical state (i.e., a transcritical cycle) between points C and D. In other embodiments, however, the pressures at points C and D may be selected or otherwise configured such that the working fluid remains in a supercritical state throughout the entire cycle. It should be noted that representative operative temperatures, pressures, and flow rates as indicated in any of the Figures or otherwise defined or described herein are by way of example only and are not in any way to be considered as limiting the scope of the disclosure.

Referring again to FIG. 1A, the use of $CO_2$ as the working fluid in thermodynamic cycles, such as in the disclosed heat engine system 100, requires particular attention to the inlet pressure of the pump 9 which has a direct influence on the overall efficiency of the system 100 and, therefore, the amount of power ultimately generated. Because of the thermo-physical properties of $CO_2$, it is beneficial to control the inlet pressure of the pump 9 as the inlet temperature of the pump 9 rises. For example, one key thermo-physical property of $CO_2$ is its near-ambient critical temperature which requires the suction pressure of the pump 9 to be controlled both above and below the critical pressure (e.g., subcritical and supercritical operation) of the $CO_2$. Another key thermo-physical property of $CO_2$ to be considered is its relatively high compressibility and low overall pressure ratio, which makes the volumetric and overall efficiency of the pump 9 more sensitive to the suction pressure margin than would otherwise be achieved with other working fluids.

In order to minimize or otherwise regulate the suction pressure of the pump 9, the heat engine system 100 may incorporate the use of a mass management system ("MMS") 110. The MMS 110 may be configured to control the inlet pressure of the pump 9 by regulating the amount of working fluid entering and/or exiting the heat engine system 100 at strategic locations in the working fluid circuit, such as at tie-in points A, B, and C. Consequently, the system 100 becomes more efficient by manipulating the suction and discharge pressures for the pump 9, and thereby increasing the pressure ratio across the turbine 3 to its maximum possible extent.

It will be appreciated that any of the various embodiments of cycles and/or working fluid circuits described herein can be considered as closed-loop fluid circuits of defined volume, wherein the amount of mass can be selectively varied both within the cycle or circuit and within the discrete portions within the cycle or circuit (e.g., between the waste heat exchanger 5 and the turbine 3 or between the cooler 12 and the pump 9). In normal operation, the working fluid mass in the high pressure side of the cycle is essentially set by the fluid flow rate and heat input. The mass contained within the low pressure side of the cycle, on the other hand, is coupled to the low-side pressure, and a means is necessary to provide optimal control of both sides. Conventional Rankine cycles (both steam and organic) use other control methods, such a vapor-liquid equilibrium to control low side pressure. In the case of a system which must operate with low-side pressures that range above and below the critical pressure, this option is not possible. Thus, actively controlling the injection and withdrawal of mass from the closed-loop fluid circuit is necessary for the proper functioning and control of a practical $ScCO_2$ system. As described below, this can be accomplished through the use of the MMS 110 and variations of the same.

As illustrated, the MMS 110 may include a plurality of valves and/or connection points 14, 15, 16, 17, 18, 21, 22, and 23, and a mass control tank 7. The valves and connection points 14, 15, 16, 17, 18, 21, 22, and 23 may be characterized as termination points where the MMS 110 is operatively connected to the heat engine system 100, provided with additional working fluid from an external source, or provided with an outlet for flaring excess working fluid or pressures. Particularly, a first valve 14 may fluidly couple the MMS 110 to the system 100 at or near tie-in point A. At tie-in point A, the working fluid may be heated and pressurized after being discharged from the waste heat exchanger 5. A second valve 15 may fluidly couple the MMS 110 to the system at or near tie-in point C. Tie-in point C may be arranged adjacent the inlet to the pump 9 where the working fluid circulating through the system 100 is generally at a low temperature and pressure. It will be appreciated, however, that tie-in point C may be arranged anywhere on the low pressure side of the system 100, without departing from the scope of the disclosure.

The mass control tank 7 may be configured as a localized storage for additional working fluid that may be added to the fluid circuit when needed in order to regulate the pressure or temperature of the working fluid within the fluid circuit. The MMS 110 may pressurize the mass control tank 7 by opening the first valve 14 to allow high-temperature, high-pressure working fluid to flow to the mass control tank 7 from tie-in point A. The first valve 14 may remain in its open position until the pressure within the mass control tank 7 is sufficient to inject working fluid back into the fluid circuit via the second valve 15 and tie-in point C. In one embodiment, the second valve 15 may be fluidly coupled to the bottom of the mass control tank 7, whereby the densest working fluid from the mass control tank 7 is injected back into the fluid circuit at or near tie-in point C. Accordingly, adjusting the position of the second valve 15 may serve to regulate the inlet pressure of the pump 9.

A third valve 16 may fluidly couple the MMS 110 to the fluid circuit at or near tie-in point B. The working fluid at tie-in point B may be more dense and at a higher pressure relative to the density and pressure on the low pressure side of the system 100, for example adjacent tie-in point C. The third valve 16 may be opened to remove working fluid from the fluid circuit at tie-in point B and deliver the removed working fluid to the mass control tank 7. By controlling the operation of the valves 14, 15, 16, the MMS 110 adds and/or removes working fluid mass to/from the system 100 without the need of a pump, thereby reducing system cost, complexity, and maintenance.

The working fluid within the mass control tank 7 may be in liquid phase, vapor phase, or both. In other embodiments, the working fluid within the mass control tank 7 may be in a supercritical state. Where the working fluid is in both vapor and liquid phases, the working fluid will tend to stratify and a phase boundary may separate the two phases, whereby the more dense working fluid will tend to settle to the bottom of the mass control tank 7 and the less dense working fluid will advance toward the top of the tank 7. Consequently, the second valve 15 will be able to deliver back to the fluid circuit the densest working fluid available in the mass control tank 7.

The MMS 110 may be configured to operate with the heat engine system 100 semi-passively. To accomplish this, the heat engine system 100 may further include first, second, and third sets of sensors 102, 104, and 106, respectively. As depicted, the first set of sensors 102 may be arranged at or adjacent the suction inlet of the pump 9, and the second set of sensors 104 may be arranged at or adjacent the outlet of the pump 9. The first and second sets of sensors 102, 104 monitor and report the working fluid pressure and temperature within the low and high pressure sides of the fluid circuit adjacent the pump 9. The third set of sensors 106 may be arranged either inside or adjacent the mass control tank 7 and be configured to measure and report the pressure and temperature of the working fluid within the tank 7.

The heat engine system 100 may further include a control system 108 that is communicable (wired or wirelessly) with each sensor 102, 104, 106 in order to process the measured and reported temperatures, pressures, and mass flow rates of the working fluid at predetermined or designated points within the system 100. The control system 108 may also communicate with external sensors (not shown) or other devices that provide ambient or environmental conditions around the system 100. In response to the reported temperatures, pressures, and mass flow rates provided by the sensors 102, 104, 106, and also to ambient and/or environmental conditions, the control system 108 may be able to adjust the general disposition of each of the valves 14, 15, 16. The control system 108 may be operatively coupled (wired or wirelessly) to each valve 14, 15, 16 and configured to activate one or more actuators, servos, or other mechanical or hydraulic devices capable of opening or closing the valves 14, 15, 16. Accordingly, the control system 108 may receive the measurement communications from each set of sensors 102, 104, 106 and selectively adjust each valve 14, 15, 16 in order to maximize operation of the heat engine system 100. As will be appreciated, control of the various valves 14, 15, 16 and related equipment may be automated or semi-automated.

In one embodiment, the control system 108 may be in communication (via wires, RF signal, etc.) with each of the sensors 102, 104, 106, etc. in the system 100 and configured to control the operation of each of the valves (e.g., 14, 15, 16) in accordance with a control software, algorithm, or other predetermined control mechanism. This may prove advantageous for being able to actively control the temperature and pressure of the working fluid at the inlet of the first pump 9, thereby selectively increasing the suction pressure of the first pump 9 by decreasing compressibility of the working fluid. Doing so may avoid damage to the pump 9 as well as increase the overall pressure ratio of the thermodynamic cycle, which improves system 100 efficiency and power output. Doing so may also raise the volumetric efficiency of the pump 9, thus allowing operation of the pump 9 at lower speeds.

In one embodiment, the control system 108 may include one or more proportional-integral-derivative (PID) controllers as a control loop feedback system. In another embodiment, the control system 108 may be any microprocessor-based system capable of storing a control program and executing the control program to receive sensor inputs and generate control signals in accordance with a predetermined algorithm or table. For example, the control system 108 may be a microprocessor-based computer running a control software program stored on a computer-readable medium. The software program may be configured to receive sensor inputs from the various pressure, temperature, flow rate, etc. sensors (e.g., sensors 102, 104, and 106) positioned throughout the working fluid circuit and generate control signals therefrom, wherein the control signals are configured to optimize and/or selectively control the operation of the working fluid circuit.

Exemplary control systems 108 that may be compatible with the embodiments of this disclosure may be further described and illustrated in U.S. patent application Ser. No. 12/880,428, filed on Sep. 13, 2010, and issued as U.S. Pat. No. 8,281,593, which is hereby incorporated by reference to the extent not inconsistent with the disclosure.

The MMS 110 may also include delivery points 17 and 18, where delivery point 17 may be used to vent working fluid from the MMS 110. Connection point 21 may be a location where additional working fluid may be added to the mass management system 110 from an external source, such as a fluid fill system (not shown). Embodiments of an exemplary fluid fill system that may be fluidly coupled to the connection point 21 to provide additional working fluid to the mass management system 110 are also described in U.S. Pat. No. 8,281,593, incorporated by reference above. The remaining connection points 22, 23 may be used in a variety of operating conditions such as start-up, charging, and shut-down of the waste heat recovery system. For example, point 22 may be a pressure relief valve.

One method of controlling the pressure of the working fluid in the low side of the heat engine system 100 is by controlling the temperature of the mass control tank 7 which feeds the low-pressure side via tie-in point C. Those skilled in the art will recognize that a desirable requirement is to maintain the suction pressure of the pump 9 above the boiling pressure of the working fluid. This can be accomplished by maintaining the temperature of the mass control tank 7 at a higher level than at the inlet of the pump 9.

Figure 1B:
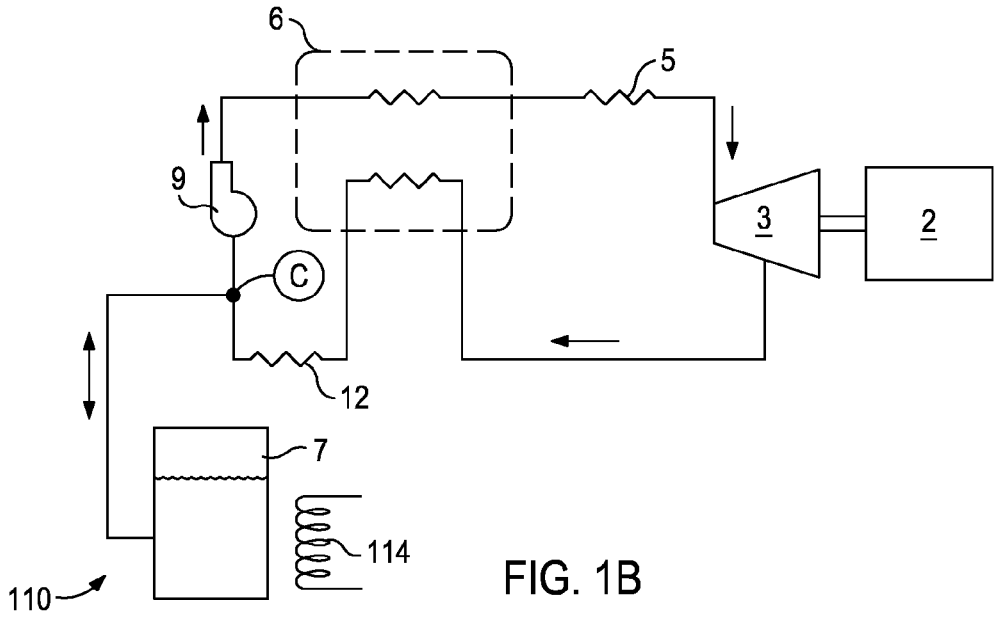
FIGS. 1B-1D illustrate various conduit arrangements and working fluid flow directions for a mass management circuit fluidly coupled to the working fluid circuit of FIG. 1A, according to one or more embodiments disclosed.
Figure 1C:
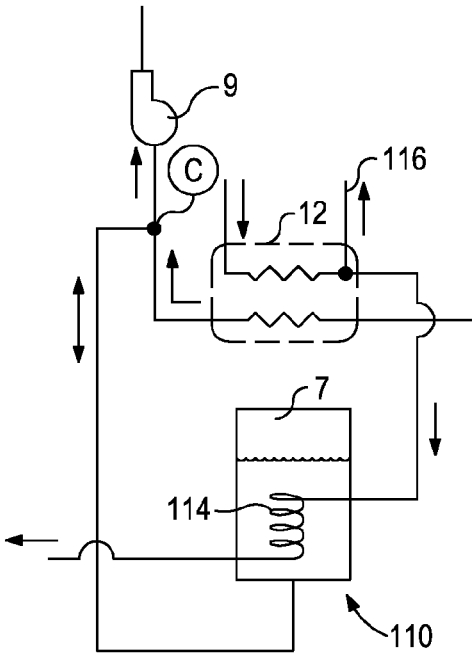
Figure 1D:
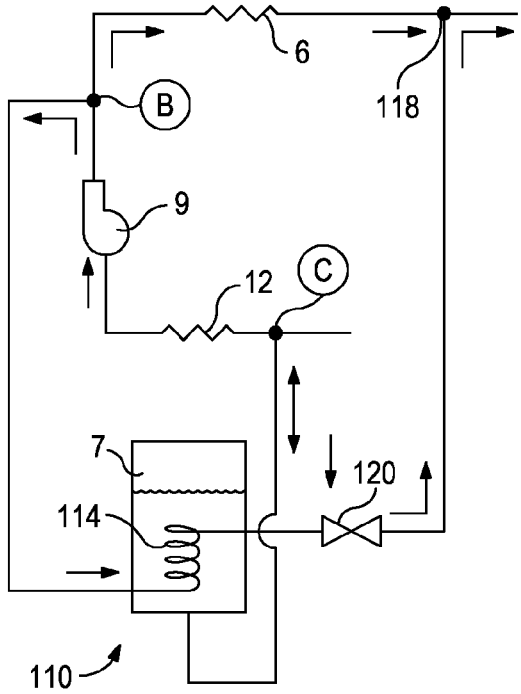

Referring to FIGS. 1B-1D, illustrated are various configurations of the mass management system 110 that may be adapted to control the pressure and/or temperature of the working fluid in the mass control tank 7, and thereby increase or decrease the suction pressure at the pump 9. Numerals and tie-in points shown in FIGS. 1B-1D correspond to like components described in FIG. 1A and therefore will not be described again in detail. Temperature control of the mass control tank 7 may be accomplished by either direct or indirect heat, such as by the use of a heat exchanger coil 114, or external heater (electrical or otherwise). The control system 108 (FIG. 1A) may be further communicably coupled to the heat exchanger coil 114 and configured to selectively engage, cease, or otherwise regulate its operation.

In FIG. 1B, the heat exchanger coil 114 may be arranged without the mass control tank 7 and provide thermal energy via convection. In other embodiments, the coil 114 may be wrapped around the tank 7 and thereby provide thermal energy via conduction. Depending on the application, the coil 114 may be a refrigeration coil adapted to cool the tank 7 or a heater coil adapted to heat the tank 7. In other embodiments, the coil 114 may serve as both a refrigerator and heater, depending on the thermal fluid circulating therein and thereby being able to selectively alter the temperature of the tank 7 according to the requirements of the system 100.

As illustrated, the mass control tank 7 may be fluidly coupled to the working fluid circuit at tie-in point C. Via tie-in point C, working fluid may be added to or extracted from the working fluid circuit, depending on the temperature of the working fluid within the tank 7. For example, heating the working fluid in the tank 7 will pressurize the tank and tend to force working fluid into the working fluid circuit from the tank 7, thereby effectively raising the suction pressure of the pump 9. Conversely, cooling the working fluid in the tank 7 will tend to withdraw working fluid from the working fluid circuit at tie-in point C and inject that working fluid into the tank 7, thereby reducing the suction pressure of the pump 9. Accordingly, working fluid mass moves either in or out of the tank 7 via tie-in point C depending on the average density of the working fluid therein.

In FIG. 1C, the coil 114 may be disposed within the mass control tank 7 in order to directly heat or cool the working fluid in the tank 7. In this embodiment, the coil 114 may be fluidly coupled to the cooler 12 and use a portion of the thermal fluid 116 circulating in the cooler 12 to heat or cool the tank 7. In one embodiment, the thermal fluid 116 in the cooler 12 may be water. In other embodiments, the thermal fluid may be a type of glycol and water, or any other thermal fluid known in the art. In yet other embodiments, the thermal fluid may be a portion of the working fluid tapped from the system 100.

In FIG. 1D, the coil 114 may again be disposed within the mass control tank 7, but may be fluidly coupled to the discharge of the pump 9 via tie-in point B. In other words, the coil 114 may be adapted to circulate working fluid that is extracted from the working fluid circuit at tie-in point B in order to heat or cool the working fluid in the tank 7, depending on the discharge temperature of the pump 9. After passing through the coil 114, the extracted working fluid may be injected back into the working fluid circuit at point 118, which may be arranged downstream from the recuperator 6. A valve 120 may be arranged in the conduit leading to point 118 for restriction or regulation of the working fluid as it re-enters the working fluid circuit.

Depending on the temperature of the working fluid extracted at tie-in point B and the amount of cooling and/or heating realized by the coil 114 in the tank 7, the mass control tank 7 may be adapted to either inject fluid into the working fluid circuit at tie-in point C or extract working fluid at tie-in point C. Consequently, the suction pressure of the pump 9 may be selectively managed to increase the efficiency of the system 100.

Figure 7:
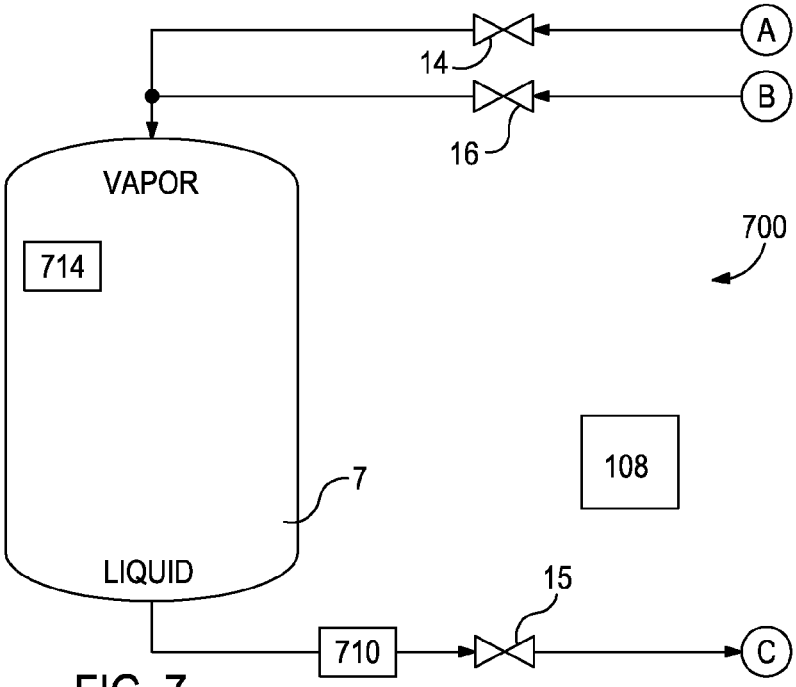
FIG. 7 schematically illustrates an embodiment of a mass management system which can be implemented with heat engine cycles, according to one or more embodiments disclosed.
Figure 8:
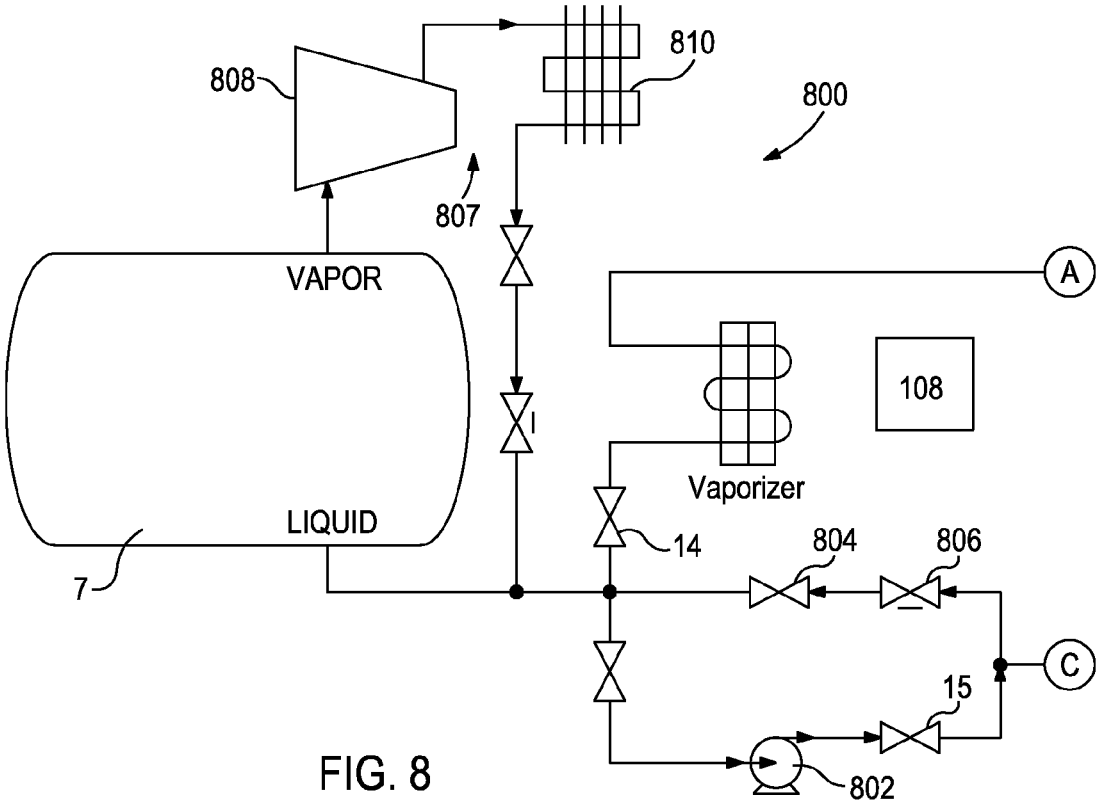
FIG. 8 schematically illustrates another embodiment of a mass management system that can be implemented with heat engine cycles, according to one or more embodiments disclosed.

Referring now to FIGS. 7 and 8, illustrated are other exemplary mass management systems 700 and 800, respectively, which may be used in conjunction with the heat engine system 100 of FIG. 1A to regulate the amount of working fluid in the fluid circuit. In one or more embodiments, the MMS 700, 800 may be similar in several respects to the MMS 110 described above and may, in one or more embodiments, entirely replace the MMS 110 without departing from the scope of the disclosure. For example, the system tie-in points A, B, and C, as indicated in FIGS. 7 and 8 (points A and C only shown in FIG. 8), correspond to the system tie-in points A, B, and C shown in FIG. 1A. Accordingly, each MMS 700, 800 may be best understood with reference to FIGS. 1A-1D, wherein like numerals represent like elements that will not be described again in detail.

The exemplary MMS 700 may be configured to store working fluid in the mass control tank 7 at or near ambient temperature. In exemplary operation, the mass control tank 7 may be pressurized by tapping working fluid from the working fluid circuit via the first valve 14 fluidly coupled to tie-in point A. The third valve 16 may be opened to permit relatively cooler, pressurized working fluid to enter the mass control tank 7 via tie-in point B. As briefly described above, extracting additional fluid from the working fluid circuit may decrease the inlet or suction pressure of the pump 9 (FIGS. 1A-1D).

When required, working fluid may be returned to the working fluid circuit by opening the second valve 15 fluidly coupled to the bottom of the mass control tank 7 and allowing the additional working fluid to flow through the third tie-in point C and into the working fluid circuit upstream from the pump 9 (FIGS. 1A-1D). In at least one embodiment, the MMS 700 may further include a transfer pump 710 configured to draw working fluid from the tank 7 and inject it into the working fluid circuit via tie-in point C. Adding working fluid back to the circuit at tie-in point C increases the suction pressure of the pump 9.

The MMS 800 in FIG. 8 may be configured to store working fluid at relatively low temperatures (e.g., sub-ambient) and therefore exhibiting low pressures. As shown, the MMS 800 may include only two system tie-ins or interface points A and C. Tie-in point A may be used to pre-pressurize the working fluid circuit with vapor so that the temperature of the circuit remains above a minimum threshold during fill. As shown, the tie-in A may be controlled using the first valve 14. The valve-controlled interface A, however, may not generally be used during the control phase, powered by the control logic defined above for moving mass into and out of the system. The vaporizer prevents the injection of liquid working fluid into the system 100 which would boil and potentially refrigerate or cool the system 100 below allowable material temperatures. Instead, the vaporizer facilitates the injection of vapor working fluid into the system 100.

In operation, when it is desired to increase the suction pressure of the pump 9 (FIGS. 1A-1D), the second valve 15 may be opened and working fluid may be selectively added to the working fluid circuit via tie-in point C. In one embodiment, the working fluid is added with the help of a transfer pump 802. When it is desired to reduce the suction pressure of the pump 9, working fluid may be selectively extracted from the system also via tie-in point C, or one of several other ports (not shown) on the low pressure storage tank 7, and subsequently expanded through one or more valves 804 and 806. The valves 804, 806 may be configured to reduce the pressure of the working fluid derived from tie-in point C to the relatively low storage pressure of the mass control tank 7.

Under most conditions, the expanded fluid following the valves 804, 806 will be two-phase fluid (i.e., vapor+liquid). To prevent the pressure in the mass control tank 7 from exceeding its normal operating limits, a small vapor compression refrigeration cycle 807 including a vapor compressor 808 and accompanying condenser 810 may be used. The refrigeration cycle 807 may be configured to decrease the temperature of the working fluid and condense the vapor in order to maintain the pressure of the mass control tank 7 at its design condition. In one embodiment, the vapor compression refrigeration cycle 807 forms an integral part of the MMS 800, as illustrated. In other embodiments, however, the vapor compression refrigeration cycle 807 may be a stand-alone vapor compression cycle with an independent refrigerant loop.

The control system 108 shown in each of the MMS 700, 800 may be configured to monitor and/or control the conditions of the working fluid and surrounding cycle environment, including temperature, pressure, flow rate and flow direction. The various components of each MMS 700, 800 may be communicably coupled to the control system 108 (wired or wirelessly) such that control of the various valves 14, 15, 16 and other components described herein is automated or semi-automated in response to system performance data obtained via the various sensors (e.g., 102, 104, 106 in FIG. 1A).

In one or more embodiments, it may prove advantageous to maintain the suction pressure of the pump 9 above the boiling pressure of the working fluid. The pressure of the working fluid in the low side of the working fluid circuit can be controlled by regulating the temperature of the working fluid in the mass control tank 7, such that the temperature of the working fluid in the mass control tank 7 is maintained at a higher level than the temperature at the inlet of the pump 9. To accomplish this, the MMS 700 may include a heater and/or a coil 714 arranged within or about the tank 7 to provide direct electric heat. The coil 714 may be similar in some respects to the coil 114 described above with reference to FIGS. 1B-1D. Accordingly, the coil 714 may be configured to add or remove heat from the fluid/vapor within the tank 7.

The exemplary mass management systems 110, 700, 800 described above may be applicable to different variations or embodiments of thermodynamic cycles having different variations or embodiments of working fluid circuits. Accordingly, the thermodynamic cycle shown in and described with reference to FIG. 1A may be replaced with other thermodynamic, power-generating cycles that may also be regulated or otherwise managed using any one of the MMS 110, 700, or 800. For example, illustrated in FIGS. 3-6 are various embodiments of cascade-type thermodynamic, power-generating cycles that may accommodate any one of the MMS 110, 700, or 800 to fluidly communicate therewith via the system tie-ins points A, B, and C, and thereby increase system performance of the respective working fluid circuits. Reference numbers shown in FIGS. 3-6 that are similar to those referred to in FIGS. 1A-1D, 7 and 8 correspond to similar components that will not be described again in detail.

Figure 3:
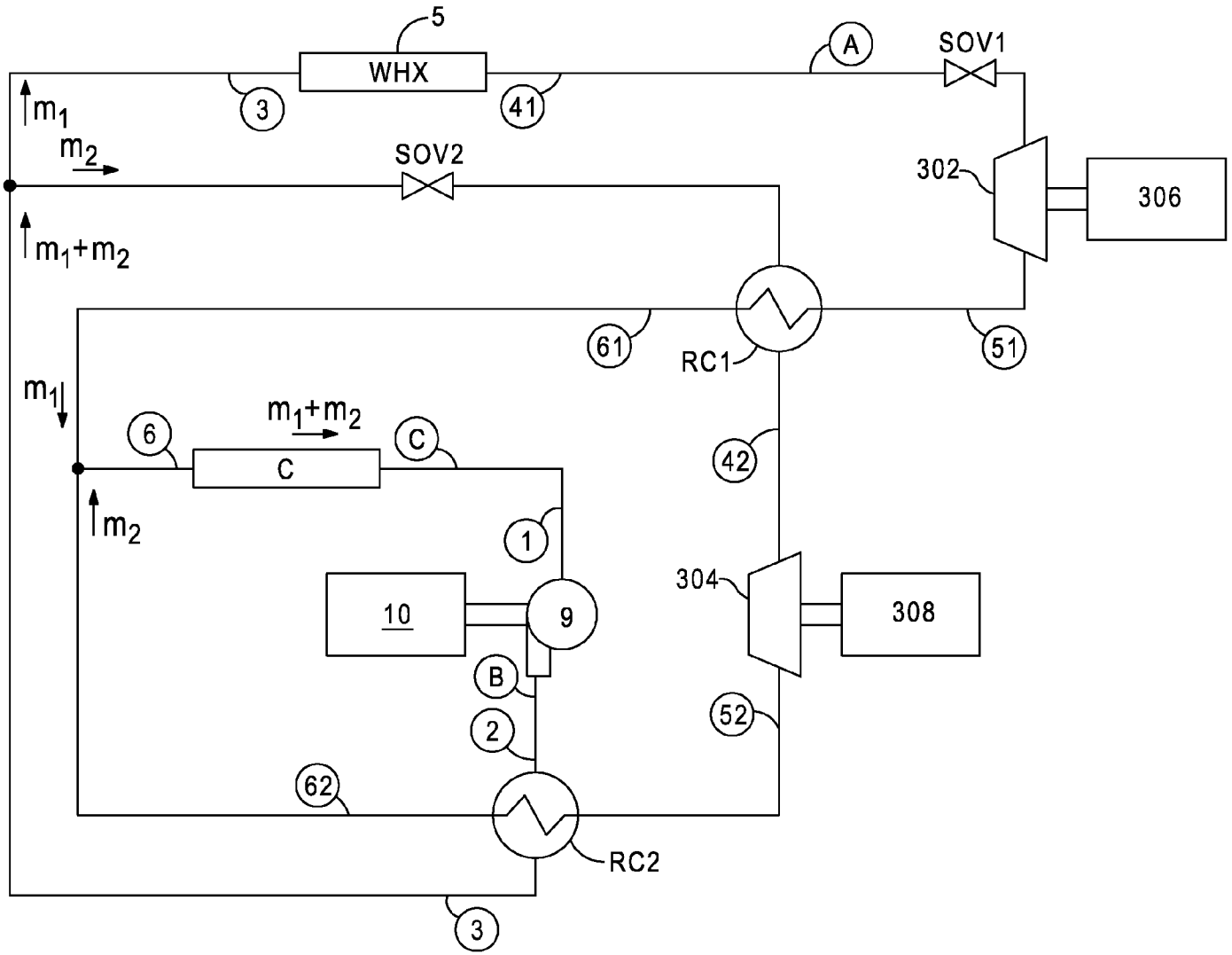
FIGS. 3-6 are schematic embodiments of various cascade thermodynamic waste heat recovery cycles that a mass management system may supplement, according to one or more embodiments disclosed.

FIG. 3 schematically illustrates an exemplary "cascade" thermodynamic cycle in which the residual thermal energy of a first portion of the working fluid $m_1$ following expansion in a first power turbine 302 (i.e., adjacent state 51) is used to preheat a second portion of the working fluid $m_2$ before being expanded through a second power turbine 304 (i.e., adjacent state 52). More specifically, the first portion of working fluid $m_1$ is discharged from the first turbine 302 and subsequently cooled at a recuperator RC1. The recuperator RC1 may provide additional thermal energy for the second portion of the working fluid $m_2$ before the second portion of the working fluid $m_2$ is expanded in the second turbine 304.

Following expansion in the second turbine 304, the second portion of the working fluid $m_2$ may be cooled in a second recuperator RC2 which also serves to pre-heat a combined working fluid flow $m_1+m_2$ after it is discharged from the pump 9. The combined working fluid $m_1+m_2$ may be formed by merging the working fluid portions $m_1$ and $m_2$ discharged from both recuperators RC1, RC2, respectively. The condenser C may be configured to receive the combined working fluid $m_1+m_2$ and reduce its temperature prior to being pumped through the fluid circuit again with the pump 9. Depending upon the achievable temperature at the suction inlet of the pump 9, and based on the available cooling supply temperature and condenser C performance, the suction pressure at the pump 9 may be either subcritical or supercritical. Moreover, any one of the MMS 110, 700, or 800 described herein may fluidly communicate with the thermodynamic cycle shown in FIG. 3 via the system tie-in points A, B, and/or C, to thereby regulate or otherwise increase system performance as generally described above.

The first power turbine 302 may be coupled to and provide mechanical rotation to a first work-producing device 306, and the second power turbine may be adapted to drive a second work-producing device 308. In one embodiment, the work-producing devices 306, 308 may be electrical generators, either coupled by a gearbox or directly driving corresponding high-speed alternators. It is also contemplated herein to connect the output of the second power turbine 304 with the second work-producing device 308, or another generator that is driven by the first turbine 302. In other embodiments, the first and second power turbines 302, 304 may be integrated into a single piece of turbomachinery, such as a multiple-stage turbine using separate blades/disks on a common shaft, or as separate stages of a radial turbine driving a bull gear using separate pinions for each radial turbine.

By using multiple turbines 302, 304 at similar pressure ratios, a larger fraction of the available heat source from the waste heat exchanger 5 is utilized and residual heat from the turbines 302, 304 is recuperated via the cascaded recuperators RC1, RC2. Consequently, additional heat is extracted from the waste heat source through multiple temperature expansions. In one embodiment, the recuperators RC1, RC2 may be similar to the waste heat exchanger 5 and include or employ one or more printed circuit heat exchange panels. Also, the condenser C may be substantially similar to the cooler 12 shown and described above with reference to FIG. 1A.

In any of the cascade embodiments disclosed herein, the arrangement or general disposition of the recuperators RC1, RC2 can be optimized in conjunction with the waste heat exchanger 5 to maximize power output of the multiple temperature expansion stages. Also, both sides of each recuperator RC1, RC2 can be balanced, for example, by matching heat capacity rates and selectively merging the various flows in the working fluid circuits through waste heat exchangers and recuperators; $C=m \cdot c_p$, where C is the heat capacity rate, m is the mass flow rate of the working fluid, and $c_p$ is the constant pressure specific heat. As appreciated by those skilled in the art, balancing each side of the recuperators RC1, RC2 provides a higher overall cycle performance by improving the effectiveness of the recuperators RC1, RC2 for a given available heat exchange surface area.

Figure 4:
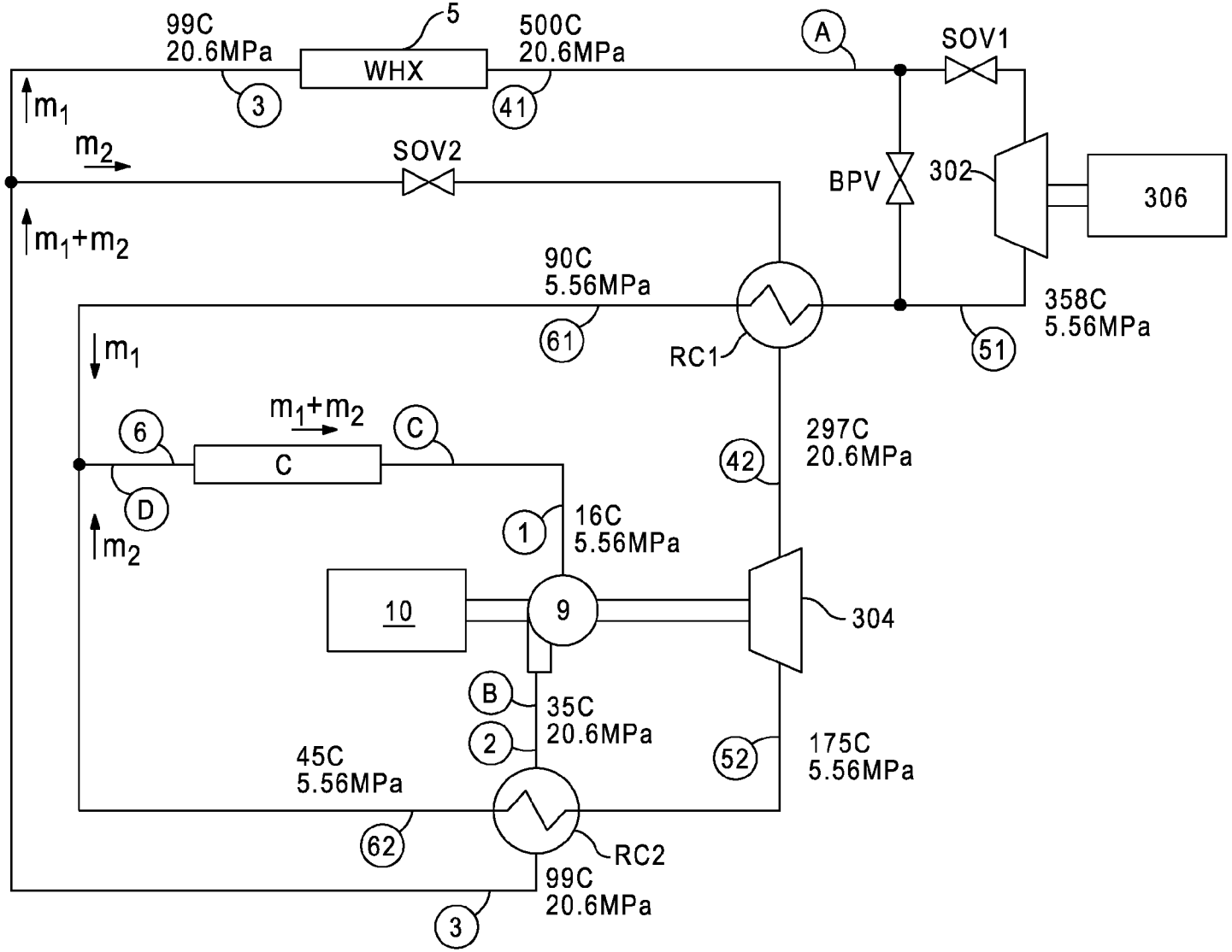

FIG. 4 is similar to FIG. 3, but with one key exception in that the second power turbine 304 may be coupled to the pump 9 either directly or through a gearbox. The motor 10 that drives the pump 9 may still be used to provide power during system startup, and may provide a fraction of the drive load for the pump 9 under some conditions. In other embodiments, however, it is possible to utilize the motor 10 as a generator, particularly if the second power turbine 304 is able to produce more power than the pump 9 requires for system operation. Likewise, any one of the MMS 110, 700, or 800 may fluidly communicate with the thermodynamic cycle shown in FIG. 4 via the system tie-in points A, B, and C, and thereby regulate or otherwise increase the system performance.

Figure 5:
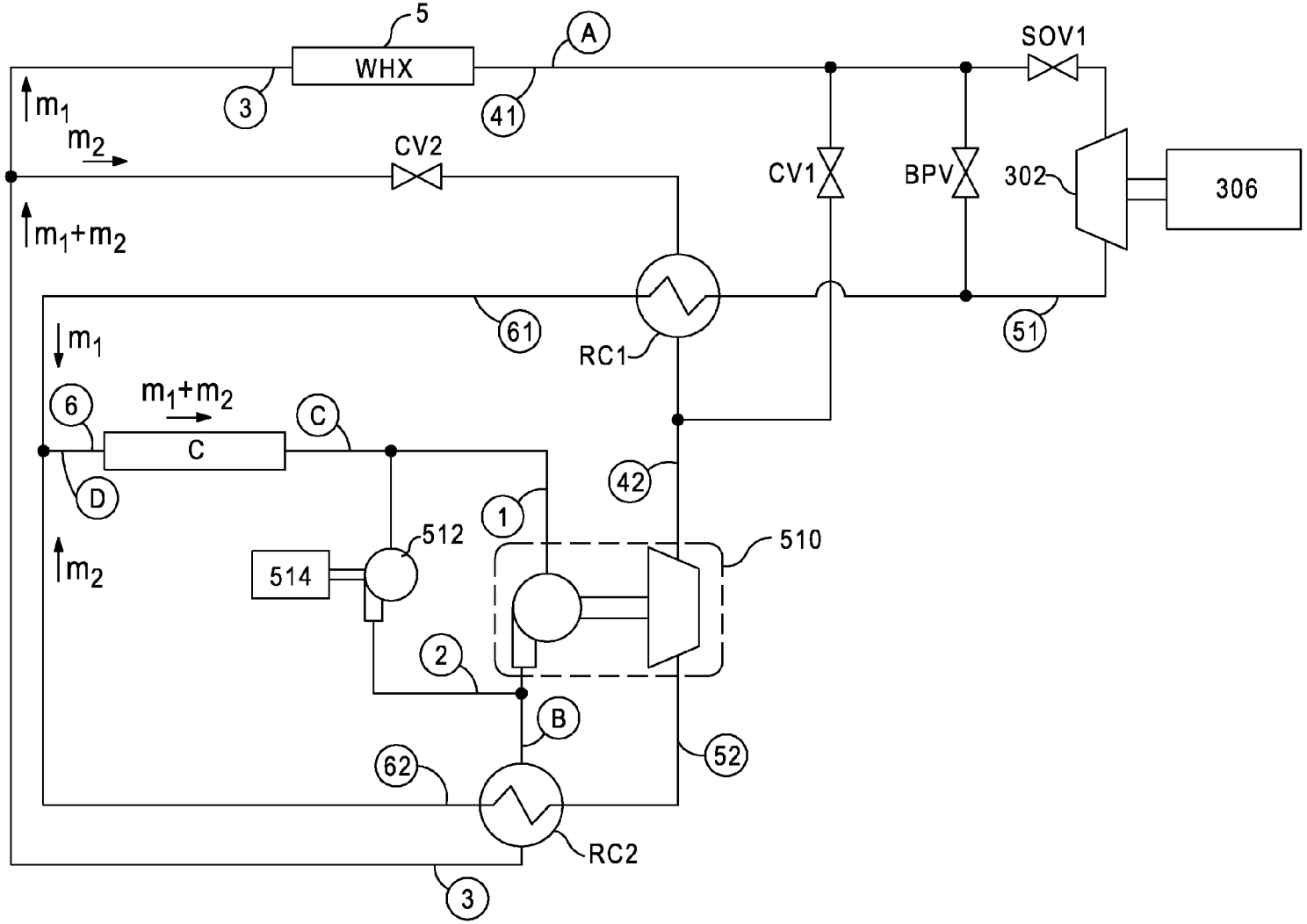

FIG. 5 is a variation of the system described in FIG. 4, whereby the motor-driven pump 9 is replaced by or operatively connected to a high-speed, direct-drive turbopump 510. As illustrated, a small "starter pump" 512 or other auxiliary pumping device may be used during system startup, but once the turbopump 510 generates sufficient power to "bootstrap" itself into steady-state operation, the starter pump 512 can be shut down. The starter pump 512 may be driven by a separate motor 514 or other auxiliary driver known in the art.

Additional control valves CV1 and CV2 may be included to facilitate operation of the turbopump 510 under varying load conditions. The control valves CV1, CV2 may also be used to channel thermal energy into the turbopump 510 before the first power turbine 302 is able to operate at steady-state. For example, at system startup the shut off valve SOV1 may be closed and the first control valve CV1 opened such that the heated working fluid discharged from the waste heat exchanger 5 may be directed to the turbopump 510 in order to drive the main system pump 9 until achieving steady-state operation. Once at steady-state operation, the control valve CV1 may be closed and the shut off valve SOV1 may be simultaneously opened in order to direct heated working fluid from the waste heat exchanger 5 to the power turbine 302.

As with FIGS. 3 and 4, any one of the MMS 110, 700, or 800 may be able to fluidly communicate with the thermodynamic cycle shown in FIG. 5 via the system tie-in points A, B, and C, and thereby regulate or otherwise increase the system performance.

Figure 6:
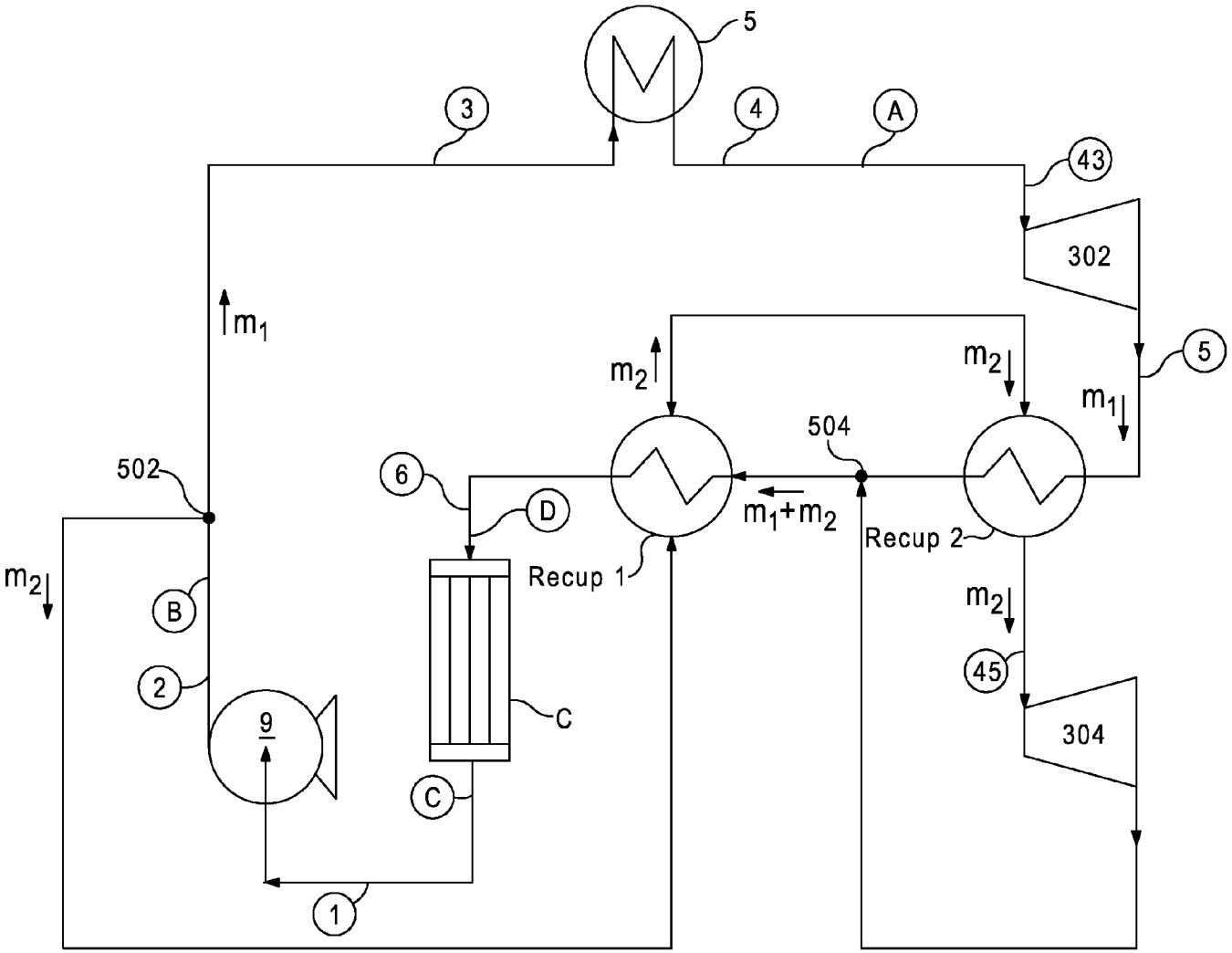

FIG. 6 schematically illustrates another exemplary cascade thermodynamic cycle that may be supplemented or otherwise regulated by the implementation of any one of the MMS 110, 700, or 800 described herein. Specifically, FIG. 6 depicts a dual cascade heat engine cycle. Following the pump 9, the working fluid may be separated at point 502 into a first portion $m_1$ and a second portion $m_2$. The first portion $m_1$ may be directed to the waste heat exchanger 5 and subsequently expanded in the first stage power turbine 302. Residual thermal energy in the exhausted first portion $m_1$ following the first stage power turbine 302 (e.g., at state 5) may be used to preheat the second portion $m_2$ in a second recuperator (Recup2) prior to being expanded in a second-stage power turbine 304.

In one embodiment, the second recuperator Recup2 may be configured to preheat the second portion $m_2$ to a temperature within approximately 5 to 10° C. of the exhausted first portion $m_1$ fluid at state 5. After expansion in the second-stage power turbine 304, the second portion $m_2$ may be re-combined with the first portion $m_1$ at point 504. The re-combined working fluid $m_1+m_2$ may then transfer initial thermal energy to the second portion $m_2$ via a first recuperator Recup1 prior to the second portion $m_2$ passing through the second recuperator Recup2, as described above. The combined working fluid $m_1+m_2$ is cooled via the first recuperator Recup1 and subsequently directed to a condenser C (e.g., state 6) for additional cooling, after which it ultimately enters the working fluid pump 9 (e.g., state 1) where the cycle starts anew.

Referring now to FIGS. 9-14, the exemplary mass management systems 110, 700, 800 described herein may also be applicable to parallel-type thermodynamic cycles, and fluidly coupled thereto via the tie-in points A, B, and/or C to increase system performance. As with the cascade cycles shown in FIGS. 3-6, some reference numbers shown in FIGS. 9-14 may be similar to those in FIGS. 1A-1D, 7, and 8 to indicate similar components that will not be described again in detail.

Figure 9:
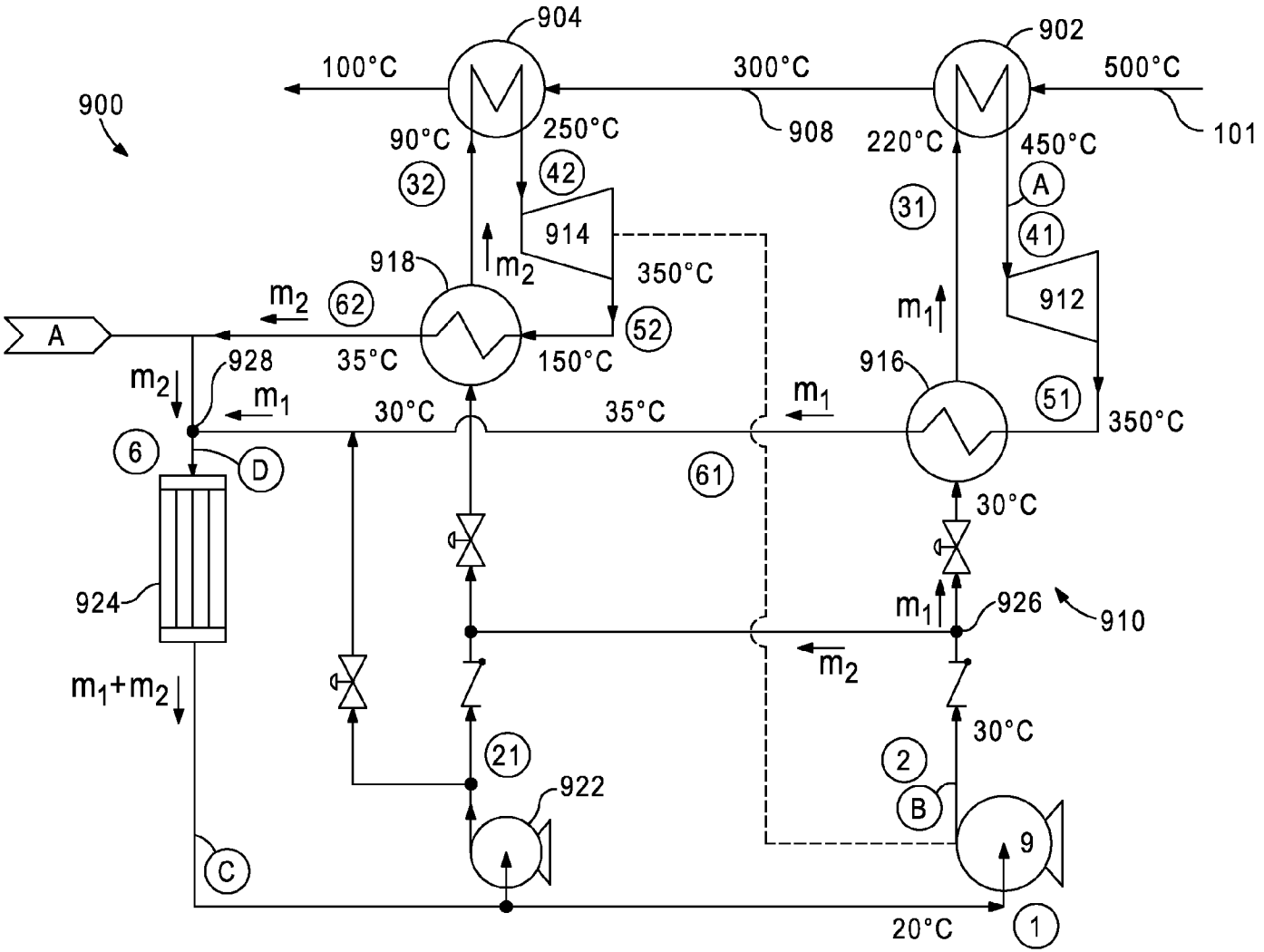
FIGS. 9-14 schematically illustrate various embodiments of parallel heat engine cycles, according to one or more embodiments disclosed.

Referring to FIG. 9, an exemplary parallel thermodynamic cycle 900 is shown and may be used to convert thermal energy to work by thermal expansion of the working fluid flowing through a working fluid circuit 910. As with prior-disclosed embodiments, the working fluid circulated in the working fluid circuit 910, and the other exemplary circuits described below, may be carbon dioxide ($CO_2$). The cycle 900 may be characterized as a Rankine cycle implemented as a heat engine device including multiple heat exchangers that are in fluid communication with a waste heat source 101. Moreover, the cycle 900 may further include multiple turbines for power generation and/or pump driving power, and multiple recuperators located downstream of and fluidly coupled to the turbine(s).

Specifically, the working fluid circuit 910 may be in thermal communication with the waste heat source 101 via a first heat exchanger 902 and a second heat exchanger 904. The first and second heat exchangers 902, 904 may correspond generally to the heat exchanger 5 described above with reference to FIG. 1A. It will be appreciated that any number of heat exchangers may be utilized in conjunction with one or more heat sources. The first and second heat exchangers 902, 904 may be waste heat exchangers. In at least one embodiment, the first and second heat exchangers 902, 904 may be first and second stages, respectively, of a single or combined waste heat exchanger.

The first heat exchanger 902 may serve as a high temperature heat exchanger (e.g., high temperature with respect to the second heat exchanger 904) adapted to receive an initial or primary flow of thermal energy from the heat source 101. In various embodiments, the initial temperature of the heat source 101 entering the cycle 900 may range from about 400° F. to greater than about 1,200° F. (i.e., about 204° C. to greater than about 650° C.). In the illustrated embodiment, the initial flow of the heat source 101 may have a temperature of about 500° C. or higher. The second heat exchanger 904 may then receive the heat source 101 via a serial connection 908 downstream from the first heat exchanger 902. In one embodiment, the temperature of the heat source 101 provided to the second heat exchanger 904 may be reduced to about 250-300° C.

The heat exchangers 902, 904 are arranged in series in the heat source 101, but in parallel in the working fluid circuit 910. The first heat exchanger 902 may be fluidly coupled to a first turbine 912 and the second heat exchanger 904 may be fluidly coupled to a second turbine 914. In turn, the first turbine 912 may also be fluidly coupled to a first recuperator 916 and the second turbine 914 may also be fluidly coupled to a second recuperator 918. One or both of the turbines 912, 914 may be a power turbine configured to provide electrical power to auxiliary systems or processes. The recuperators 916, 918 may be arranged in series on a low temperature side of the circuit 910 and in parallel on a high temperature side of the circuit 910.

The pump 9 may circulate the working fluid throughout the circuit 910 and a second, starter pump 922 may also be in fluid communication with the components of the fluid circuit 910. The first and second pumps 9, 922 may be turbopumps, motor-driven pumps, or combinations thereof. In one embodiment, the first pump 9 may be used to circulate the working fluid during normal operation of the cycle 900 while the second pump 922 may be nominally driven and used generally for starting the cycle 900. In at least one embodiment, the second turbine 914 may be used to drive the first pump 9, but in other embodiments the first turbine 912 may be used to drive the first pump 9, or the first pump 9 may be nominally driven by an external or auxiliary machine (not shown).

The first turbine 912 may operate at a higher relative temperature (e.g., higher turbine inlet temperature) than the second turbine 914, due to the temperature drop of the heat source 101 experienced across the first heat exchanger 902. In one or more embodiments, however, each turbine 912, 914 may be configured to operate at the same or substantially the same inlet pressure. This may be accomplished by design and control of the circuit 910, including but not limited to the control of the first and second pumps 9, 922 and/or the use of multiple-stage pumps to optimize the inlet pressures of each turbine 912, 914 for corresponding inlet temperatures of the circuit 910. This is also accomplished through the use of one of the exemplary MMS 110, 700, or 800 that may be fluidly coupled to the circuit 910 at tie-in points A, B, and/or C, whereby the MMS 110, 700, or 800 regulates the working fluid pressure in order to maximize power outputs.

The working fluid circuit 910 may further include a condenser 924 in fluid communication with the first and second recuperators 916, 918. The low-pressure discharge working fluid flow exiting each recuperator 916, 918 may be directed through the condenser 924 to be cooled for return to the low temperature side of the circuit 910 and to either the first or second pumps 9, 922.

In operation, the working fluid is separated at point 926 in the working fluid circuit 910 into a first mass flow $m_1$ and a second mass flow $m_2$. The first mass flow $m_1$ is directed through the first heat exchanger 902 and subsequently expanded in the first turbine 912. Following the first turbine 912, the first mass flow $m_1$ passes through the first recuperator 916 in order to transfer residual heat back to the first mass flow $m_1$ as it is directed toward the first heat exchanger 902. The second mass flow $m_2$ may be directed through the second heat exchanger 904 and subsequently expanded in the second turbine 914. Following the second turbine 914, the second mass flow $m_2$ passes through the second recuperator 918 to transfer residual heat back to the second mass flow $m_2$ as it is directed toward the second heat exchanger 904. The second mass flow $m_2$ is then re-combined with the first mass flow $m_1$ at point 928 to generate a combined mass flow $m_1+m_2$. The combined mass flow $m_1+m_2$ may be cooled in the condenser 924 and subsequently directed back to the pump 9 to commence the fluid loop anew.

Figure 10:
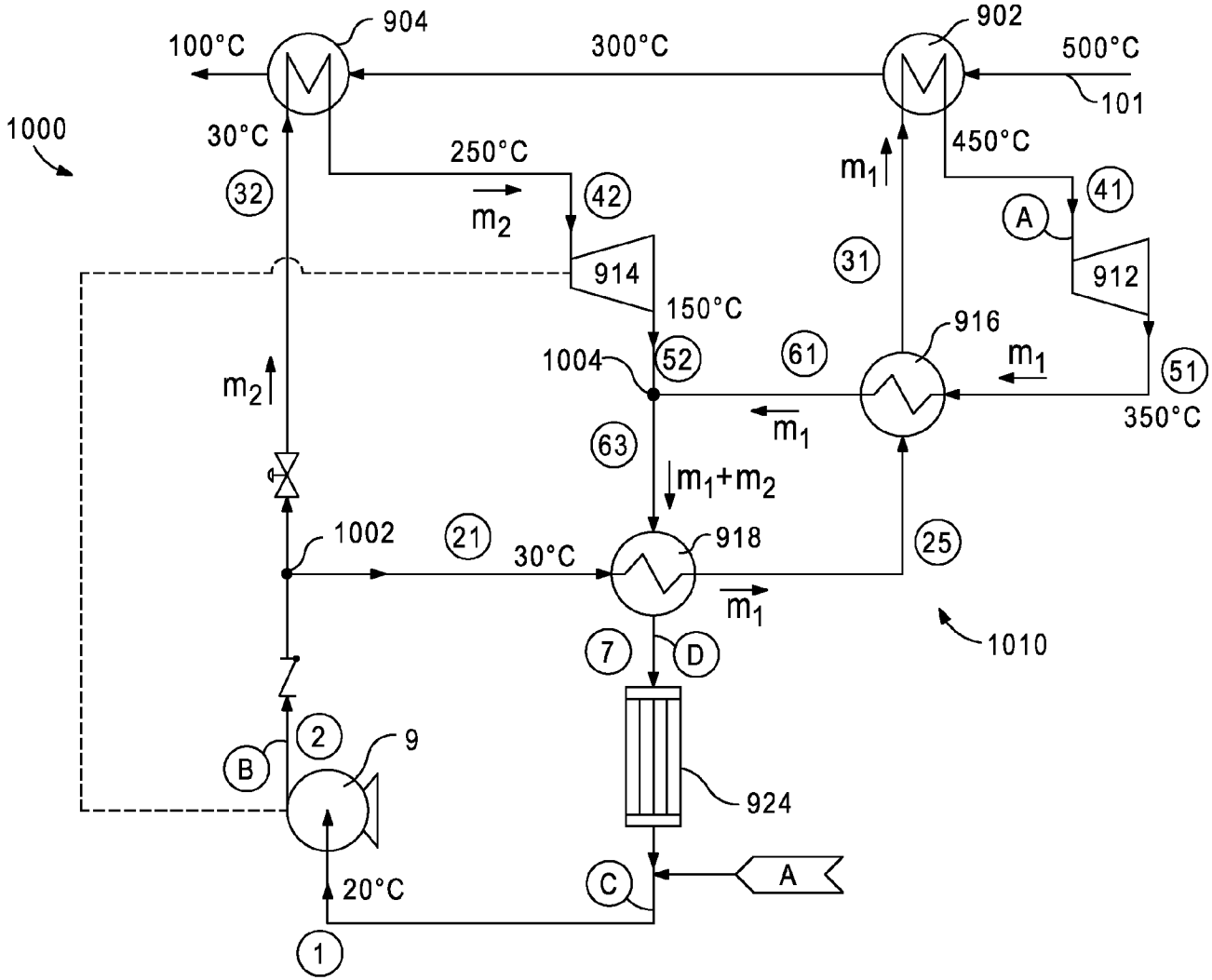

FIG. 10 illustrates another exemplary parallel thermodynamic cycle 1000, according to one or more embodiments, where one of the MMS 110, 700, and/or 800 may be fluidly coupled thereto via tie-in points A, B, and/or C to regulate working fluid pressure for maximizing power outputs. The cycle 1000 may be similar in some respects to the thermodynamic cycle 900 described above with reference to FIG. 9. Accordingly, the thermodynamic cycle 1000 may be best understood with reference to FIG. 9, where like numerals correspond to like elements that will not be described again in detail. The cycle 1000 includes the first and second heat exchangers 902, 904 again arranged in series in thermal communication with the heat source 101, and arranged in parallel within a working fluid circuit 1010.

In the circuit 1010, the working fluid is separated into a first mass flow $m_1$ and a second mass flow $m_2$ at a point 1002. The first mass flow $m_1$ is eventually directed through the first heat exchanger 902 and subsequently expanded in the first turbine 912. The first mass flow $m_1$ then passes through the first recuperator 916 to transfer residual thermal energy back to the first mass flow $m_1$ that is coursing past state 25 and into the first recuperator 916. The second mass flow $m_2$ may be directed through the second heat exchanger 904 and subsequently expanded in the second turbine 914. Following the second turbine 914, the second mass flow $m_2$ is merged with the first mass flow $m_1$ at point 1004 to generate the combined mass flow $m_1+m_2$. The combined mass flow $m_1+m_2$ may be directed through the second recuperator 918 to transfer residual thermal energy to the first mass flow $m_1$ as it passes through the second recuperator 918 on its way to the first recuperator 916.

The arrangement of the recuperators 916, 918 allows the residual thermal energy in the combined mass flow $m_1+m_2$ to be transferred to the first mass flow $m_1$ in the second recuperator 918 prior to the combined mass flow $m_1+m_2$ reaching the condenser 924. As can be appreciated, this may increase the thermal efficiency of the working fluid circuit 1010 by providing better matching of the heat capacity rates, as defined above.

In one embodiment, the second turbine 914 may be used to drive (shown as dashed line) the first or main working fluid pump 9. In other embodiments, however, the first turbine 912 may be used to drive the pump 9. The first and second turbines 912, 914 may be operated at common turbine inlet pressures or different turbine inlet pressures by management of the respective mass flow rates at the corresponding states 41 and 42.

Figure 11:
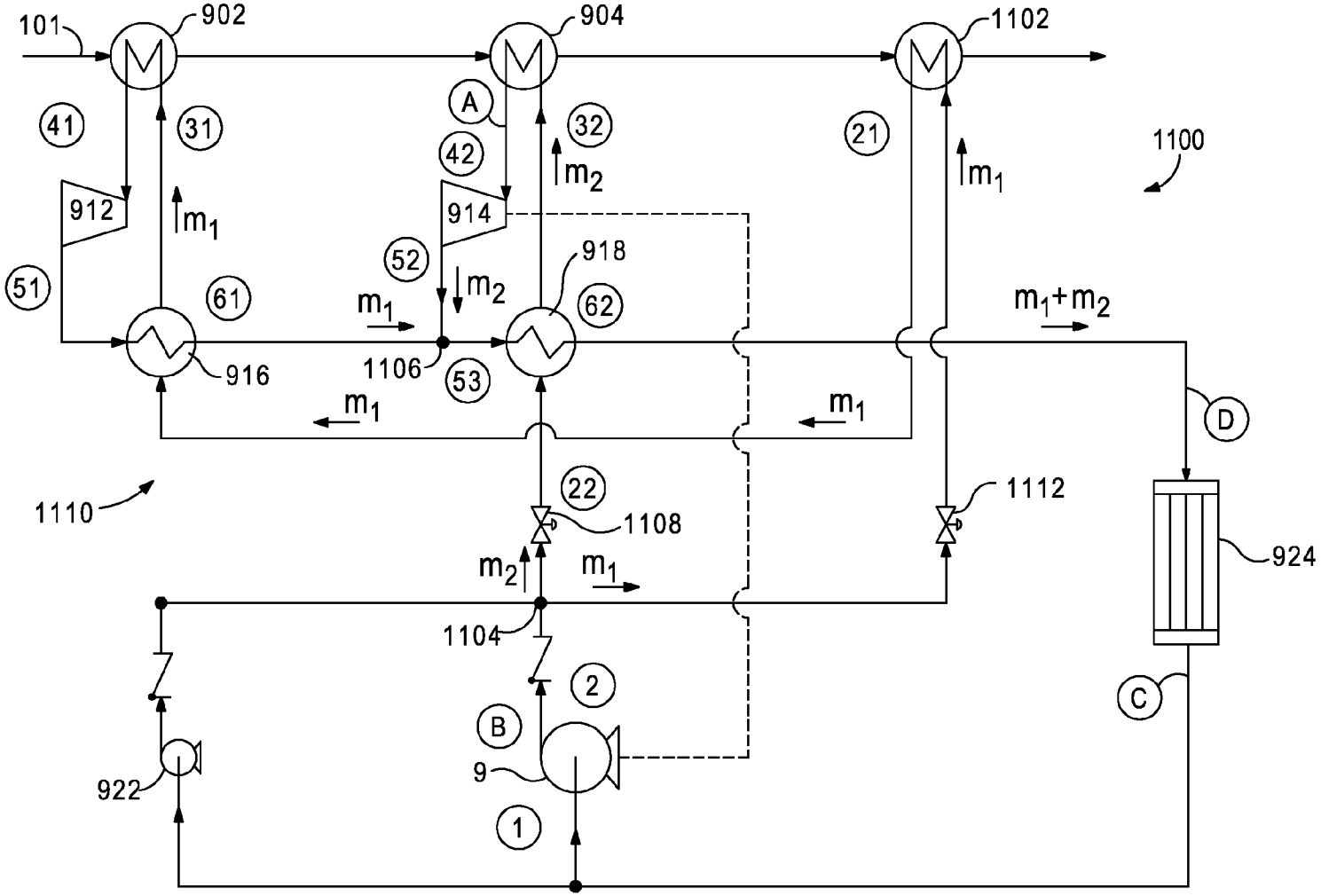

FIG. 11 illustrates another embodiment of a parallel thermodynamic cycle 1100, according to one or more embodiments, where one of the MMS 110, 700, and/or 800 may be fluidly coupled thereto via tie-in points A, B, and/or C to regulate working fluid pressure for maximizing power outputs. The cycle 1100 may be similar in some respects to the thermodynamic cycles 900 and 1000 and therefore may be best understood with reference to FIGS. 9 and 10, where like numerals correspond to like elements that will not be described again. The thermodynamic cycle 1100 may include a working fluid circuit 1110 utilizing a third heat exchanger 1102 in thermal communication with the heat source 101. The third heat exchanger 1102 may similar to the first and second heat exchangers 902, 904, as described above.

The heat exchangers 902, 904, 1102 may be arranged in series in thermal communication with the heat source 101, and arranged in parallel within the working fluid circuit 1110. The corresponding first and second recuperators 916, 918 are arranged in series on the low temperature side of the circuit 1110 with the condenser 924, and in parallel on the high temperature side of the circuit 1110. After the working fluid is separated into first and second mass flows $m_1$, $m_2$ at point 1104, the third heat exchanger 1102 may be configured to receive the first mass flow $m_1$ and transfer thermal energy from the heat source 101 to the first mass flow $m_1$. Accordingly, the third heat exchanger 1102 may be adapted to initiate the high temperature side of the circuit 1110 before the first mass flow $m_1$ reaches the first heat exchanger 902 and the first turbine 912 for expansion therein. Following expansion in the first turbine 912, the first mass flow $m_1$ is directed through the first recuperator 916 to transfer residual thermal energy to the first mass flow $m_1$ discharged from the third heat exchanger 1102 and coursing toward the first heat exchanger 902.

The second mass flow $m_2$ is directed through the second heat exchanger 904 and subsequently expanded in the second turbine 914. Following the second turbine 914, the second mass flow $m_2$ is merged with the first mass flow $m_1$ at point 1106 to generate the combined mass flow $m_1+m_2$ which provides residual thermal energy to the second mass flow $m_2$ in the second recuperator 918 as the second mass flow $m_2$ courses toward the second heat exchanger 904. The working fluid circuit 1110 may also include a throttle valve 1108, such as a pump-drive throttle valve, and a shutoff valve 1112 to manage the flow of the working fluid.

Figure 12:
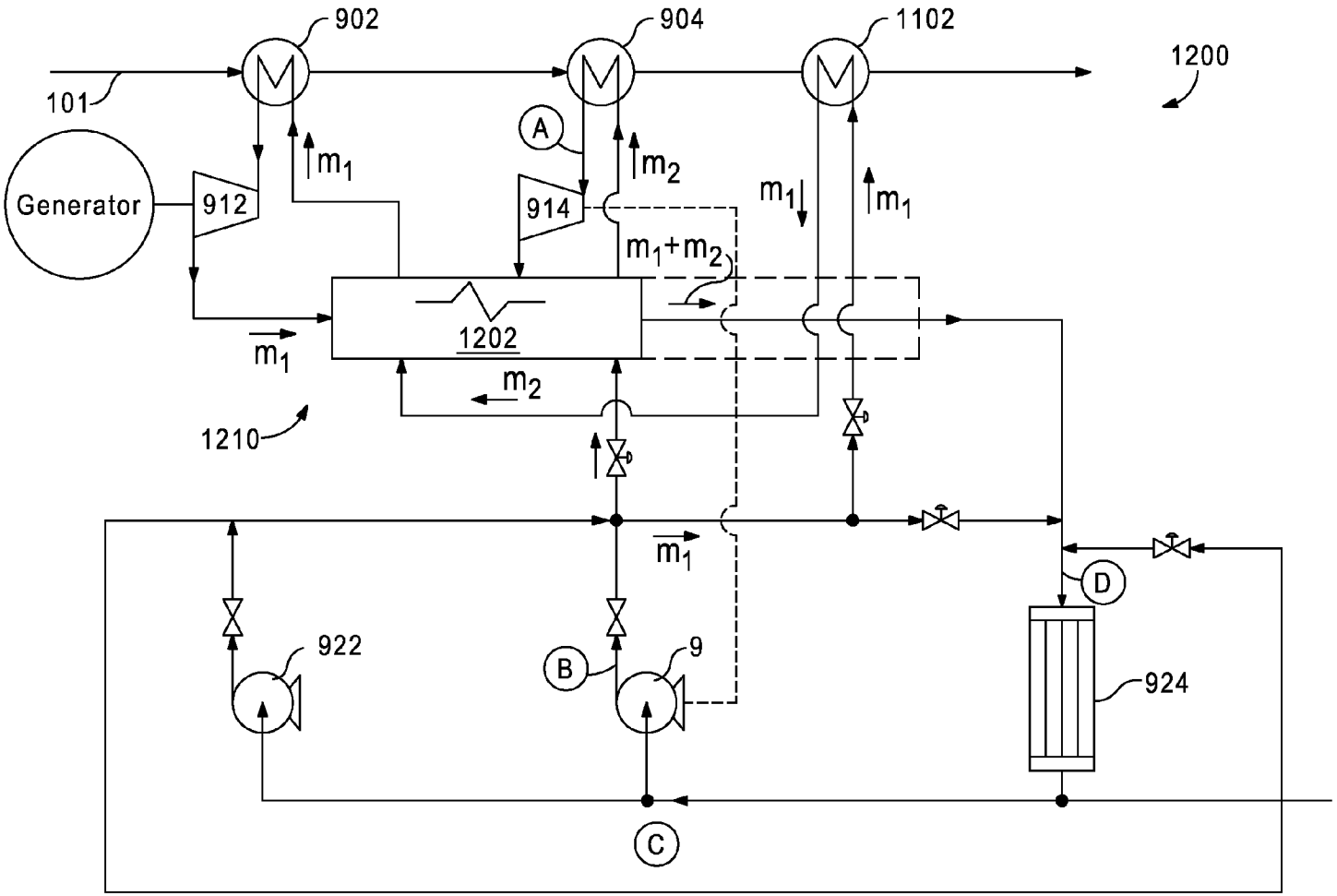

FIG. 12 illustrates another embodiment of a parallel thermodynamic cycle 1200, according to one or more embodiments disclosed, where one of the MMS 110, 700, and/or 800 may be fluidly coupled thereto via tie-in points A, B, and/or C to regulate working fluid pressure for maximizing power outputs. The cycle 1200 may be similar in some respects to the thermodynamic cycles 900, 1000, and 1100, and as such, the cycle 1200 may be best understood with reference to FIGS. 9-11 where like numerals correspond to like elements that will not be described again. The thermodynamic cycle 1200 may include a working fluid circuit 1210 where the first and second recuperators 916, 918 are combined into or otherwise replaced with a single, combined recuperator 1202. The recuperator 1202 may be of a similar type as the recuperators 916, 918 described herein, or may be another type of recuperator or heat exchanger known in the art.

As illustrated, the combined recuperator 1202 may be configured to transfer heat to the first mass flow $m_1$ before it enters the first heat exchanger 902 and receive heat from the first mass flow $m_1$ after it is discharged from the first turbine 912. The combined recuperator 1202 may also transfer heat to the second mass flow $m_2$ before it enters the second heat exchanger 904 and also receive heat from the second mass flow $m_2$ after it is discharged from the second turbine 914. The combined mass flow $m_1+m_2$ flows out of the recuperator 1202 and to the condenser 924 for cooling.

As indicated by the dashed lines extending from the recuperator 1202, the recuperator 1202 may be enlarged or otherwise adapted to accommodate additional mass flows for thermal transfer. For example, the recuperator 1202 may be adapted to receive the first mass flow $m_1$ before entering and after exiting the third heat exchanger 1102. Consequently, additional thermal energy may be extracted from the recuperator 1202 and directed to the third heat exchanger 1102 to increase the temperature of the first mass flow $m_1$.

Figure 13:
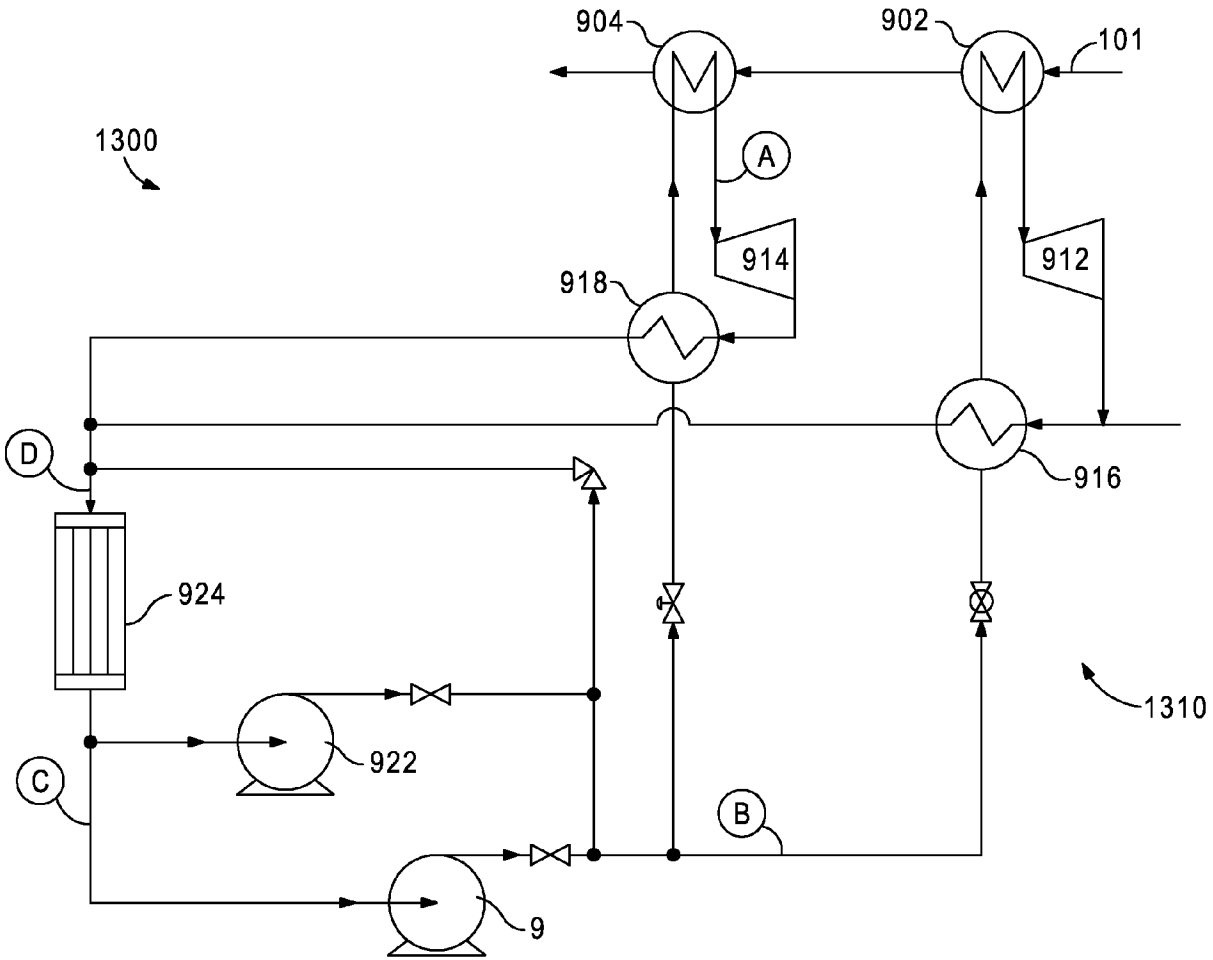

FIG. 13 illustrates another embodiment of a parallel thermodynamic cycle 1300 according to the disclosure, where one of the MMS 110, 700, and/or 800 may be fluidly coupled thereto via tie-in points A, B, and/or C to regulate working fluid pressure for maximizing power outputs. The cycle 1300 may be similar in some respects to the thermodynamic cycle 900, and as such, may be best understood with reference to FIG. 9 above where like numerals correspond to like elements that will not be described again in detail. The thermodynamic cycle 1300 may have a working fluid circuit 1310 substantially similar to the working fluid circuit 910 of FIG. 9 but with a different arrangement of the first and second pumps 9, 922.

Figure 14:
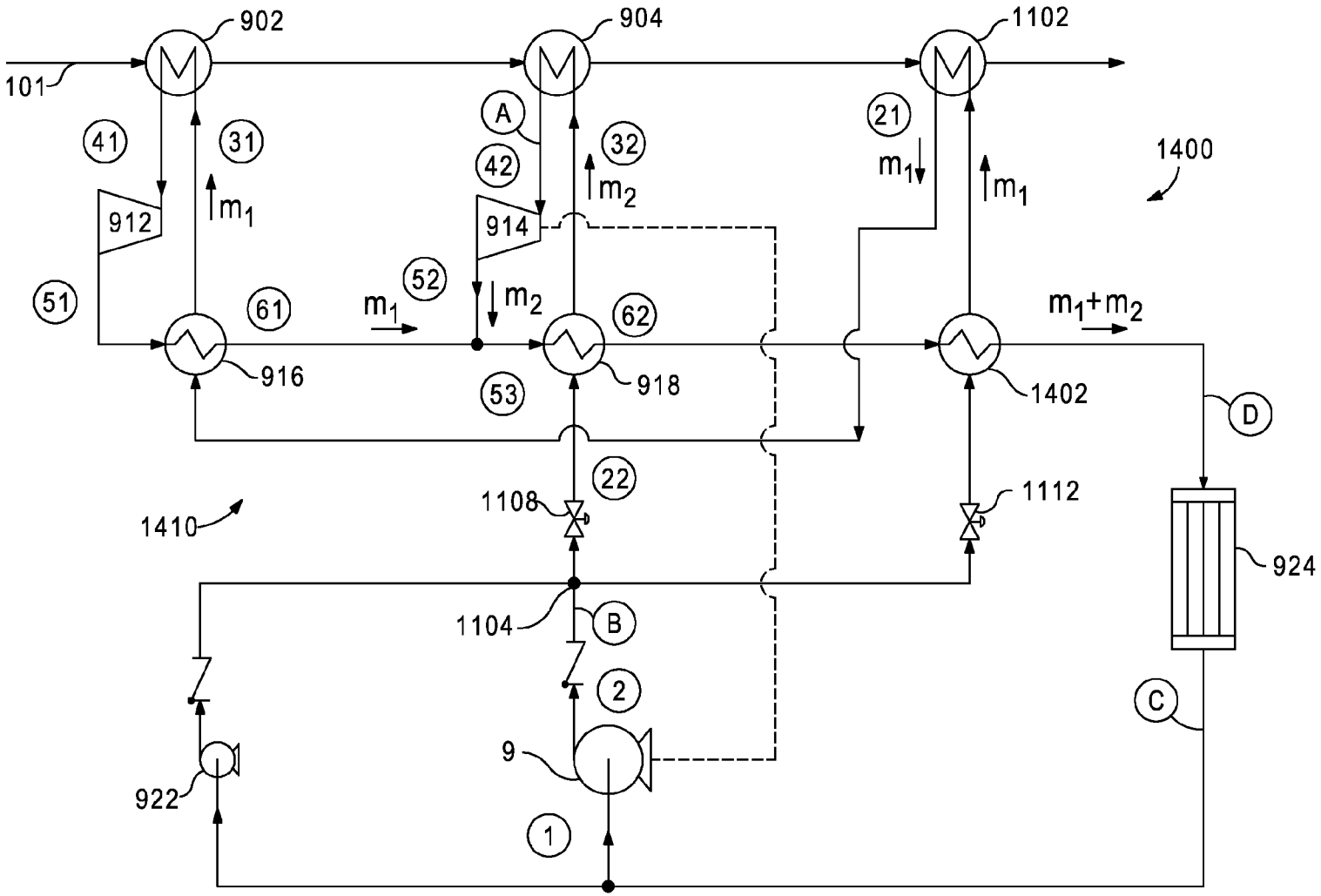

FIG. 14 illustrates another embodiment of a parallel thermodynamic cycle 1400 according to the disclosure, where one of the MMS 110, 700, and/or 800 may be fluidly coupled thereto via tie-in points A, B, and/or C to regulate working fluid pressure for maximizing power outputs. The cycle 1400 may be similar in some respects to the thermodynamic cycle 1100, and as such, may be best understood with reference to FIG. 11 above where like numerals correspond to like elements that will not be described again. The thermodynamic cycle 1400 may have a working fluid circuit 1410 substantially similar to the working fluid circuit 1110 of FIG. 11 but with the addition of a third recuperator 1402 adapted to extract additional thermal energy from the combined mass flow $m_1+m_2$ discharged from the second recuperator 918. Accordingly, the temperature of the first mass flow $m_1$ entering the third heat exchanger 1102 may be preheated prior to receiving residual thermal energy transferred from the heat source 101.

As illustrated, the recuperators 916, 918, 1402 may operate as separate heat exchanging devices. In other embodiments, however, the recuperators 916, 918, 1402 may be combined into a single recuperator, similar to the recuperator 1202 described above with reference to FIG. 12.

Each of the described cycles 900-1400 from FIGS. 9-14 may be implemented in a variety of physical embodiments, including but not limited to fixed or integrated installations, or as a self-contained device such as a portable waste heat engine "skid." The exemplary waste heat engine skid may arrange each working fluid circuit 910-1410 and related components (i.e., turbines 912, 914, recuperators 916, 918, 1202, 1402, condensers 924, pumps 9, 922, etc.) into a consolidated, single unit. An exemplary waste heat engine skid is described and illustrated in co-pending U.S. patent application Ser. No. 12/631,412, entitled "Thermal Energy Conversion Device," filed on Dec. 9, 2009, the contents of which are hereby incorporated by reference to the extent not inconsistent with the present disclosure.

The mass management systems 110, 700, and 800 described herein provide and enable: i) independent control suction margin at the inlet of the pump 9, which enables the use of a low-cost, high-efficiency centrifugal pump, through a cost effective set of components; ii) mass of working fluid of different densities to be either injected or withdrawn (or both) from the system at different locations in the cycle based on system performance; and iii) centralized control by a mass management system operated by control software with inputs from sensors in the cycle and functional control over the flow of mass into and out of the system.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

We claim:

1. A heat engine system for converting thermal energy into mechanical energy, comprising:

a working fluid circuit configured to circulate a working fluid through a high pressure side and a low pressure side of the working fluid circuit, the working fluid circuit further comprises:

a heat exchanger configured to be coupled to and in thermal communication with a heat source and to transfer thermal energy from the heat source to the working fluid within the high pressure side;

an expander in fluid communication with the heat exchanger and fluidly arranged between the high and low pressure sides;

a recuperator fluidly coupled to the expander and configured to transfer thermal energy between the high and low pressure sides;

a cooler in fluid communication with the recuperator and configured to control a temperature of the working fluid in the low pressure side; and a pump fluidly coupled to the cooler and configured to circulate the working fluid through the working fluid circuit; and a mass management system fluidly coupled to the working fluid circuit and configured to regulate a pressure and an amount of the working fluid within the working fluid circuit, the mass management system further comprises:

a mass control tank fluidly coupled to the high pressure side at a first tie-in point located upstream of the expander and to the low pressure side at a second tie-in point located upstream of an inlet of the pump; and a control system communicably coupled to the working fluid circuit at a first sensor disposed upstream to the inlet of the pump and at a second sensor disposed downstream from an outlet of the pump, and communicably coupled to the mass control tank at a third sensor arranged either within or adjacent the mass control tank.

2. The system of claim 1, wherein the working fluid comprises carbon dioxide.

3. The system of claim 1, wherein the mass management system further comprises a heat exchanger coil configured to transfer heat to and from the mass control tank.

4. The system of claim 3, wherein the heat exchanger coil is disposed within the mass control tank.

5. The system of claim 3, wherein the heat exchanger coil is fluidly coupled to the cooler and configured to use thermal fluid derived from the cooler to heat or cool the working fluid in the mass control tank.

6. The system of claim 3, wherein the heat exchanger coil is fluidly coupled to the working fluid circuit downstream from the pump and configured to use the working fluid discharged from the pump to heat or cool the working fluid in the mass control tank.

7. The system of claim 1, further comprising:

a first valve arranged between the mass control tank and the first tie-in point; and a second valve arranged between the mass control tank and the second tie-in point.

8. The system of claim 7, wherein the control system is operatively coupled to and configured to selectively actuate the first and second valves in response to operating parameters derived from the first, second, and third sensors.

9. The system of claim 7, wherein the mass control tank is further fluidly coupled to the high pressure side of the working fluid circuit at a third tie-in point arranged downstream from the pump, a third valve is disposed between the mass control tank and the third tie-in point, and the control system is operatively coupled to and configured to selectively actuate the third valve in response to operating parameters derived from the first, second, or third sensors.

10. The system of claim 1, wherein the mass management system further comprises a transfer pump arranged between the mass control tank and the second tie-in point, wherein the transfer pump is configured to pump the working fluid from the mass control tank and into the working fluid circuit via the second tie-in point.

11. The system of claim 1, wherein the mass management system further comprises a vapor compression refrigeration cycle having a vapor compressor and a condenser fluidly coupled to the mass control tank.

12. The system of claim 1, wherein the mass management system further comprises an external heater communicable with the mass control tank to transfer thermal energy thereto.

13. A method for regulating a pressure and an amount of a working fluid in a thermodynamic cycle, comprising:

placing a thermal energy source in thermal communication with a heat exchanger arranged within a working fluid circuit, the working fluid circuit having a high pressure side and a low pressure side;

circulating the working fluid through the working fluid circuit with a pump;

expanding the working fluid in an expander to generate mechanical energy;

sensing operating parameters of the working fluid circuit with first and second sensor sets communicably coupled to a control system, wherein the first sensor set is configured to sense at least one of a pressure and a temperature proximate an inlet of the pump, and the second sensor set is configured to sense at least one of the pressure and the temperature proximate an outlet of the pump;

extracting the working fluid from the working fluid circuit at a first tie-in point arranged upstream of the expander in the high pressure side, wherein the first tie-in point is fluidly coupled to a mass control tank; and injecting the working fluid from the mass control tank into the working fluid circuit via a second tie-in point arranged upstream of an inlet of the pump to increase a suction pressure of the pump.

14. The method of claim 13, further comprising extracting additional working fluid from the working fluid circuit at a third tie-in point arranged between the pump and the heat exchanger.

15. The method of claim 13, wherein injecting the working fluid from the mass control tank into the working fluid circuit via the second tie-in point further comprises pumping the working fluid into the working fluid circuit with a transfer pump arranged between the second tie-in point and the mass control tank.

16. The method of claim 13, further comprising sensing operating parameters of the mass control tank with a third sensor set configured to sense at least one of the pressure and the temperature either within or adjacent the mass control tank, wherein the third sensor set is communicably coupled to the control system.

17. The method of claim 13, further comprising cooling the working fluid within the mass control tank with a vapor compression refrigeration cycle having a vapor compressor and a condenser fluidly coupled to the mass control tank.

18. The method of claim 13, further comprising heating the working fluid within the mass control tank with an external heater in communication with the mass control tank.

* * * * *